US010295934B2

(12) United States Patent
Hatanaka

(10) Patent No.: US 10,295,934 B2
(45) Date of Patent: May 21, 2019

(54) TONER CONTAINER, IMAGE FORMING UNIT, AND IMAGE FORMING APPARATUS

(71) Applicant: Oki Data Corporation, Tokyo (JP)

(72) Inventor: Shun Hatanaka, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 16/047,196

(22) Filed: Jul. 27, 2018

(65) Prior Publication Data

US 2019/0064702 A1 Feb. 28, 2019

(30) Foreign Application Priority Data

Aug. 31, 2017 (JP) ..... 2017-166655

(51) Int. Cl.
*G03G 15/08* (2006.01)
*G03G 21/16* (2006.01)

(52) U.S. Cl.
CPC ..... *G03G 15/0889* (2013.01); *G03G 15/0822* (2013.01); *G03G 15/0865* (2013.01); *G03G 15/0887* (2013.01); *G03G 15/0891* (2013.01); *G03G 15/0896* (2013.01); *G03G 21/1609* (2013.01); *G03G 21/1676* (2013.01);
(Continued)

(58) Field of Classification Search
CPC ..... G03G 15/0822; G03G 15/0865; G03G 15/0887; G03G 15/0889; G03G 15/0891; G03G 15/0896; G03G 21/1609; G03G 21/1676; G03G 2215/06; G03G 2215/066; G03G 2215/0663; G03G 2215/0665; G03G 2215/0802; G03G 2215/0816;
(Continued)

(56) References Cited

U.S. PATENT DOCUMENTS 8,218,998 B2 * 7/2012 Koido ..... G03G 15/0898 399/103
2007/0223941 A1 * 9/2007 Dawson ..... G03G 15/0875 399/12

(Continued)

FOREIGN PATENT DOCUMENTS

JP 2006-113146 A 4/2006
JP 2006-171072 A 6/2006
JP 2008-026829 A 2/2008

*Primary Examiner* — Joseph S Wong
(74) *Attorney, Agent, or Firm* — Rabin & Berdo, P.C.

(57) ABSTRACT

A toner container includes containing chambers, a shaft member, rotary members, and stirring members. The containing chambers are arrayed in a first direction and partitioned from each other. The containing chambers contain respective toners of different colors. The shaft member extends in the first direction, passes through the containing chambers, and is rotatable about a rotational axis extending in the first direction. The rotary members are disposed in the respective containing chambers and each have a through-hole extending in the first direction. The rotary members are rotatable in response to rotation of the shaft member in an inserted state of the shaft member in the through-holes. The stirring members are supported by the respective rotary members and each extend in a second direction intersecting the first direction. The stirring members are pivotable in response to rotation of the respective rotary members. The stirring members have different pivoting positions upon pivoting.

12 Claims, 16 Drawing Sheets

(52) U.S. Cl.
CPC ... *G03G 2215/06* (2013.01); *G03G 2215/066* (2013.01); *G03G 2215/0663* (2013.01); *G03G 2215/0665* (2013.01); *G03G 2215/0802* (2013.01); *G03G 2215/085* (2013.01); *G03G 2215/0816* (2013.01); *G03G 2215/0819* (2013.01); *G03G 2215/0822* (2013.01); *G03G 2215/0852* (2013.01)

(58) Field of Classification Search
CPC ... G03G 2215/0819; G03G 2215/0822; G03G 2215/085; G03G 2215/0852
See application file for complete search history.

(56) References Cited

U.S. PATENT DOCUMENTS

| | | | | |
|---|---|---|---|---|
| 2008/0025758 | A1* | 1/2008 | Sato | G03G 15/0142 399/119 |
| 2017/0329277 | A1* | 11/2017 | Ushikubo | G03G 21/1647 |
| 2018/0217552 | A1* | 8/2018 | Kitamura | G03G 21/12 |

* cited by examiner

TONER CONTAINER, IMAGE FORMING UNIT, AND IMAGE FORMING APPARATUS

CROSS REFERENCE TO RELATED APPLICATIONS

The present application claims priority from Japanese Patent Application No. 2017-166655 filed on Aug. 31, 2017, the entire contents of which are hereby incorporated by reference.

BACKGROUND

The technology relates to a toner container that contains toners of colors different from each other and also relates to an image forming unit and an image forming apparatus in each of which the toner container is used.

An image forming apparatus of an electrophotographic scheme is in widespread use. One reason for this is that the image forming apparatus of the electrophotographic scheme is able to achieve a clearer image in a shorter time, as compared with an image forming apparatus that uses another scheme such as an inkjet scheme.

The image forming apparatus of the electrophotographic scheme, which will be referred to simply as the "image forming apparatus" hereinafter, includes an image forming unit that attaches a toner to a latent image, e.g., an electrostatic latent image, and the image forming unit includes a toner container that contains the toner.

In the process of forming an image, the toner attached to the electrostatic latent image is transferred onto a print medium, and that toner is thereafter fixed to the print medium. Thus, an image is formed on the print medium.

Various proposals have already been made regarding a configuration of the image forming apparatus. In one example, a toner cartridge that contains toners of colors different from each other is used. In this case, to keep the toners of different colors from mixing together, only a toner of an appropriate color is discharged from the toner cartridge through a toner feeding port in a state in which the toner cartridge is mounted in a cartridge mounting unit, as disclosed in Japanese Unexamined Patent Application Publication No. 2006-113146, for example.

SUMMARY

Although some specific studies have been conducted concerning a case where a toner cartridge that contains toners of colors different from each other is used, a sufficient achievement has not yet been made from the viewpoint of improving image quality, which still leaves room for improvement.

It is desirable to provide a toner container, an image forming unit, and an image forming apparatus that make it possible to form a higher-quality image.

According to one embodiment of the technology, there is provided a toner container that includes a plurality of containing chambers, a shaft member, a plurality of rotary members, and a plurality of stirring members. The containing chambers are arrayed in a first direction and partitioned from each other. The containing chambers contain respective toners of colors different from each other. The shaft member extends in the first direction and passes through each of the containing chambers. The shaft member is rotatable about a rotational axis extending in the first direction. The rotary members are disposed in the respective containing chambers. The rotary members each have a through-hole extending in the first direction. The rotary members are rotatable in response to rotation of the shaft member in an inserted state of the shaft member in the through-holes. The stirring members are supported by the respective rotary members. The stirring members each extend in a second direction intersecting the first direction. The stirring members are pivotable in response to rotation of the respective rotary members. The stirring members have pivoting positions different from each other upon pivoting.

According to one embodiment of the technology, there is provided an image forming unit that includes a containing section and a developing process section. The containing section contains toners of colors different from each other. The developing process section attaches the toners of colors different from each other and fed from the containing section onto a latent image. The containing section includes a plurality of containing chambers, a shaft member, a plurality of rotary members, and a plurality of stirring members. The containing chambers are arrayed in a first direction and partitioned from each other. The containing chambers contain the respective toners of colors different from each other. The shaft member extends in the first direction and passes through each of the containing chambers. The shaft member is rotatable about a rotational axis extending in the first direction. The rotary members disposed in the respective containing chambers. The rotary members each have a through-hole extending in the first direction. The rotary members are rotatable in response to rotation of the shaft member in an inserted state of the shaft member in the through-holes. The stirring members are supported by the respective rotary members. The stirring members each extend in a second direction intersecting the first direction. The stirring members are pivotable in response to rotation of the respective rotary members. The stirring members have pivoting positions different from each other upon pivoting.

According to one embodiment of the technology, there is provided an image forming apparatus that includes a developing section, a transfer section, and a fixing section. The developing section includes a containing section and a developing process section. The containing section contains toners of colors different from each other. The developing process section attaches the toners of colors different from each other and fed from the containing section onto a latent image. The transfer section transfers, onto a print medium, the toners of colors different from each other and attached to the latent image. The fixing section fixes, to the print medium, the toners of colors different from each other and transferred onto the print medium. The containing section includes a plurality of containing chambers, a shaft member, a plurality of rotary members, and a plurality of stirring members. The containing chambers are arrayed in a first direction and partitioned from each other. The containing chambers contain the respective toners of colors different from each other. The shaft member extends in the first direction and passes through each of the containing chambers. The shaft member is rotatable about a rotational axis extending in the first direction. The rotary members are disposed in the respective containing chambers. The rotary members each have a through-hole extending in the first direction. The rotary members are rotatable in response to rotation of the shaft member in an inserted state of the shaft member in the through-holes. The stirring members are supported by the respective rotary members. The stirring members each extend in a second direction intersecting the first direction. The stirring members are pivotable in response to rotation of the respective rotary members. The stirring members have pivoting positions different from each other upon pivoting.

DETAILED DESCRIPTION

Figure 1:
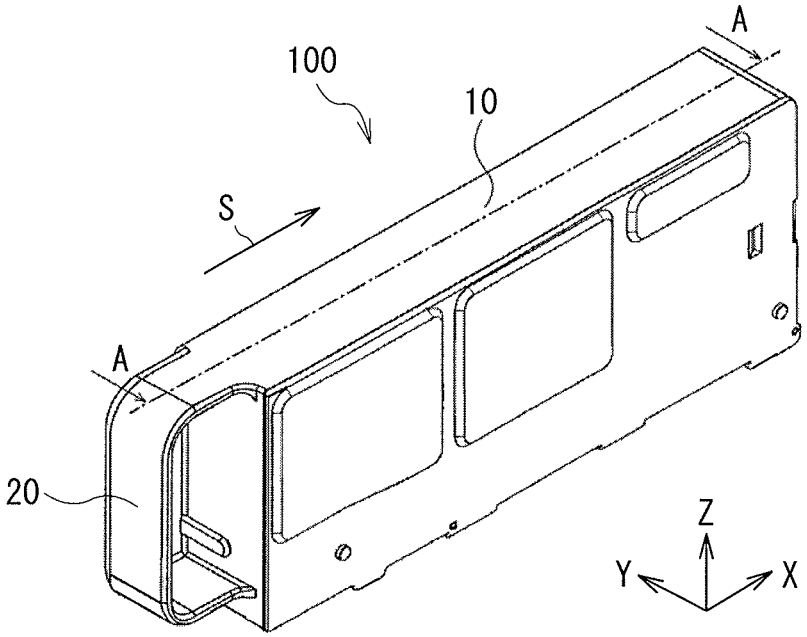
FIG. 1 is a perspective view illustrating an example of a configuration of a toner container, i.e., a toner cartridge, according to one example embodiment of the technology.

Hereinafter, some example embodiments of the technology will be described in detail with reference to the drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail. The description will be given in the following order.

1. Toner Container
   1-1. General Configuration
   1-2. Internal Configuration
   1-3. Detailed Configurations of Driving Shaft, Rotary Bodies, and Stirring Plates
   1-4. Configuration of Toner
   1-5. Operation
   1-6. Example Workings and Example Effects
   1-7. Modification Examples
2. Image Forming Unit
   2-1. Configuration
   2-2. Operation
   2-3. Example Workings and Example Effects
3. Image Forming Apparatus
   3-1. Configuration
   3-2. Operation
   3-3. Example Workings and Example Effects

[1. Toner Container]

A toner container according to one example embodiment of the technology will be described.

[1-1. General Configuration]

First, a general configuration of a toner cartridge 100, serving as an example of the toner container, will be described.

The toner cartridge 100 described in this example may be used in a full-color printer of an electrophotographic scheme, for example. The toner cartridge 100 may mainly contain a toner to be used to form an image on a print medium such as paper.

In one example, the toner cartridge 100 may contain toners of colors different from each other, i.e., toners of a plurality of colors. The types of the toners of the plurality of colors, i.e., the colors of the toners, are not particularly limited. Hereinafter, the toners of the plurality of colors may be referred to simply as the "toners" as well.

FIG. 1 illustrates a perspective view of a configuration of the toner cartridge 100. As illustrated in FIG. 1, the toner cartridge 100 may include a containing section 10 and a holder 20, for example.

[Containing Section]

The containing section 10 may mainly contain the toners. The containing section 10 may extend in an X-axis direction, for example. A mounting direction S indicated in FIG. 1 may represent a direction in which a containing section 230, corresponding to the toner cartridge 100, is mounted into a mounting section 220 in an image forming unit 200, which will be described later with reference to FIG. 39. As is apparent from FIG. 1, the mounting direction S may extend in the X-axis direction, for example.

[Holder]

The holder 20 may mainly be a portion that is held by a user who handles the toner cartridge 100. The holder 20 may be attached to the containing section 10 at one end thereof in the direction in which the containing section 10 extends, for example.

[1-2. Internal Configuration]

Next, an internal configuration of the toner cartridge 100 will be described. In this example, an internal configuration of the containing section 10 will mainly be described.

Figure 2:
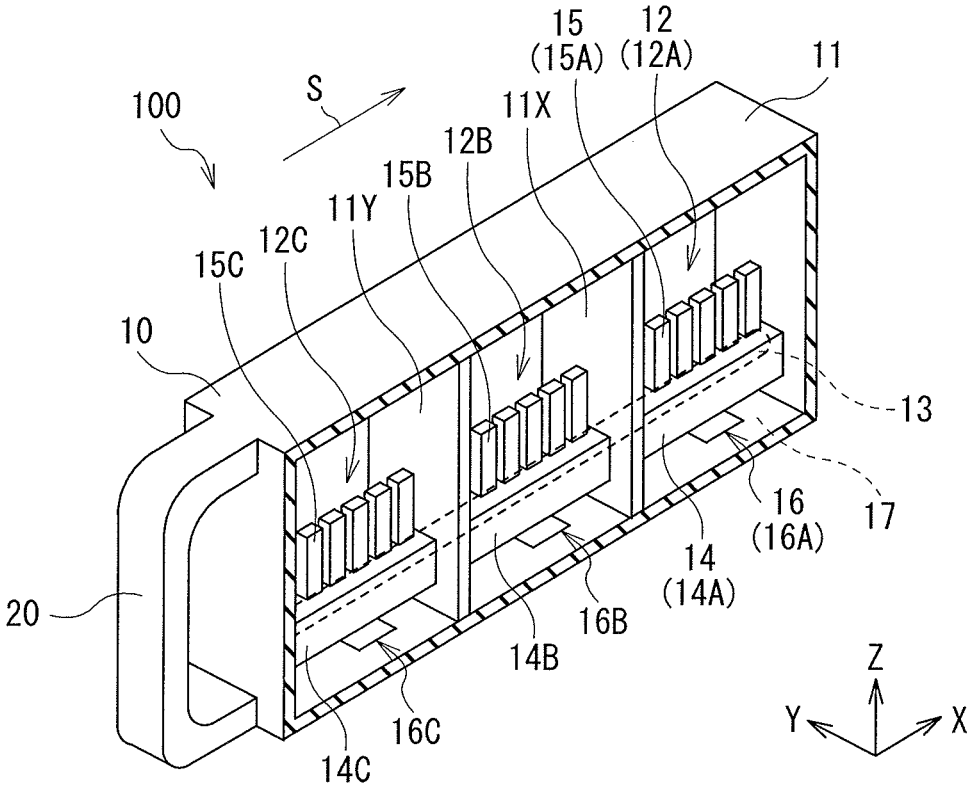
FIG. 2 is a perspective cross-sectional view illustrating an example of a configuration of the toner cartridge, taken along an A-A line indicated in FIG. 1.
Figure 3:
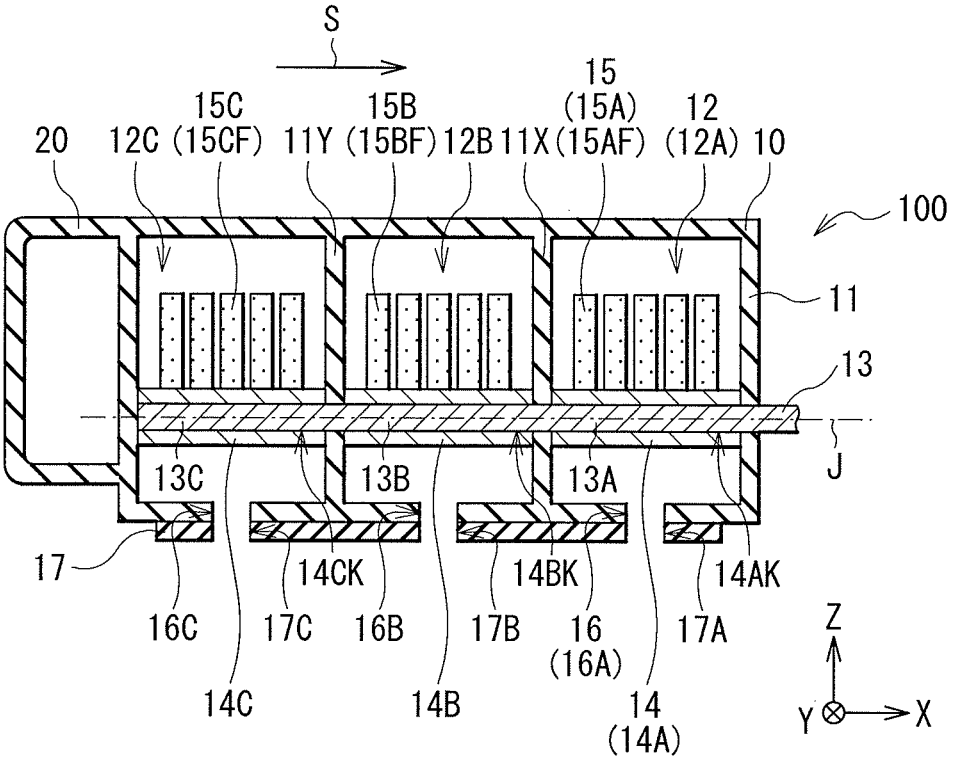
FIG. 3 is a cross-sectional view illustrating an example of a configuration of the toner cartridge, taken along the A-A line indicated in FIG. 1, and illustrating a state in which a discharge port is open.
Figure 4:
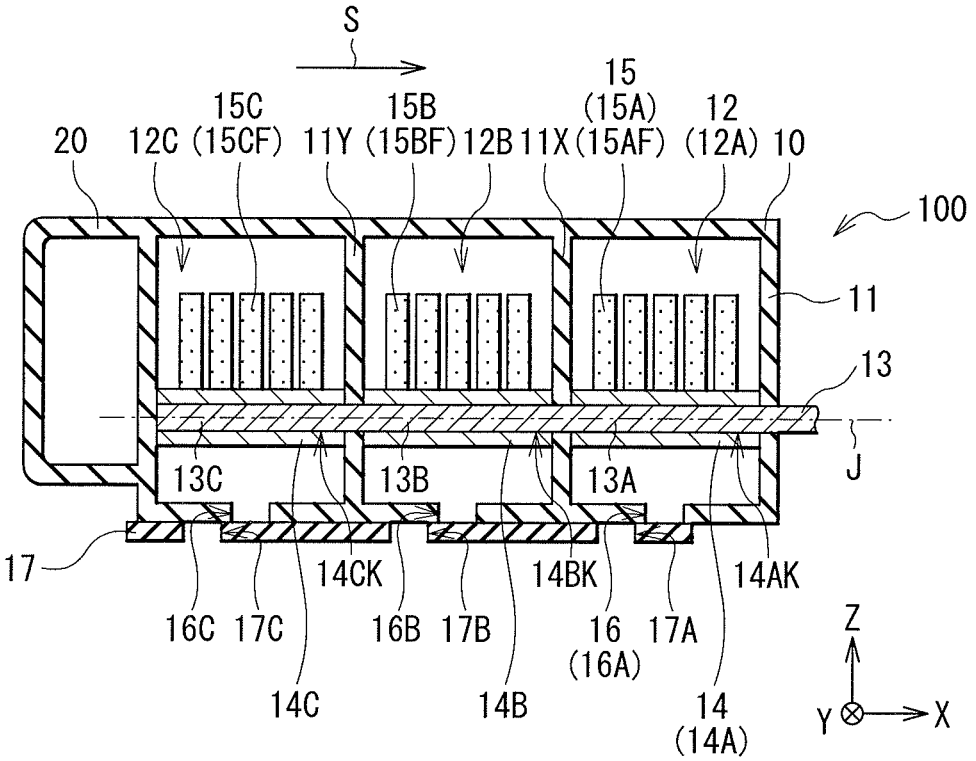
FIG. 4 is a cross-sectional view illustrating an example of a configuration of the toner cartridge, taken along the A-A line indicated in FIG. 1, and illustrating a state in which the discharge port is closed.

FIG. 2 illustrates a perspective view of a cross-sectional configuration of the toner cartridge 100, taken along an A-A line indicated in FIG. 1. FIGS. 3 and FIG. 4 each illustrate a cross-sectional configuration of the toner cartridge 100, taken along the A-A line indicated in FIG. 1. FIG. 3 illustrates a state in which a discharge port 16 is open, and FIG. 4 illustrates a state in which the discharge port 16 is closed.

As illustrated in FIG. 2 to FIG. 4, the containing section 10 may include a plurality of containing chambers 12 defined inside a housing 11, for example. The containing section 10 may include, for example, a driving shaft 13, a plurality of rotary bodies 14, and a plurality of stirring plates 15, and these components may be housed inside the housing 11. A shutter 17 may be attached to one surface, e.g., a lower surface, of the housing 11, for example.

[Housing]

The housing 11 may be a containing member that mainly provides, or defines, the containing chambers 12 and houses components such as the stirring plates 15. The containing chambers 12 may contain the toners of the respective colors, as described above, for example.

The number of the containing chambers 12 is not particularly limited as long as there are two or more containing chambers 12. In this example, the containing section 10 may include three containing chambers 12, i.e., containing chambers 12A, 12B, and 12C, defined inside the housing 11, for example.

As such, the interior of the housing 11 may be divided, or partitioned, by two partition walls 11X and 11Y, for example. The partition wall 11X may provide a partition, for example, between the containing chambers 12A and 12B. The partition wall 11Y may provide a partition, for example, between the containing chambers 12B and 12C.

In other words, the containing chambers 12A, 12B, and 12C may be arrayed in this order, for example, in the X-axis direction and partitioned off by the partition walls 11X and 11Y. In one example, the containing chambers 12A, 12B, and 12C may be arrayed in this order in the direction opposite to the mounting direction S and partitioned off by the partition walls 11X and 11Y. The X-axis direction may correspond to a "first direction" in one specific but non-limiting embodiment of the technology. Thus, the containing chamber 12A may be disposed more anteriorly than the containing chamber 12C in the mounting direction S, and the containing chamber 12C may be disposed more posteriorly than the containing chamber 12A in the mounting direction S.

In this example, as described above, the containing chambers 12A, 12B, and 12C may contain the toners of the respective colors, for example. Thus, the containing section 10 may contain toners of three colors, for example.

The colors of the toners contained in the containing chambers 12A, 12B, and 12C are not particularly limited. In this example, the containing chamber 12A may contain a yellow toner, for example. The containing chamber 12B may contain a magenta toner, for example. The containing chamber 12C may contain a cyan toner, for example.

A plurality of discharge ports 16, i.e., discharge ports 16A, 16B, and 16C, may be provided, for example, in one surface, e.g., the lower surface, of the housing 11. The toners of the plurality of colors contained in the respective containing chambers 12, i.e., the containing chambers 12A, 12B, and 12C, may be discharged outside through the discharge ports 16A, 16B, and 16C, for example. The positions where the discharge ports 16A, 16B, and 16C are provided may correspond, respectively, to the positions of the containing chambers 12A, 12B, and 12C, for example. The "outside" to which the toners are discharged through the discharge ports 16A, 16B, and 16C may be, for example, a developing process section 210 of the image forming unit 200, which will be described later with reference to FIG. 39.

The yellow toner contained in the containing chamber 12A may be discharged outside through the discharge port 16A, for example. The magenta toner contained in the containing chamber 12B may be discharged outside through the discharge port 16B, for example. The cyan toner contained in the containing chamber 12C may be discharged outside through the discharge port 16C, for example.

[Driving Shaft]

The driving shaft 13 may correspond to a "shaft member" in one specific but non-limiting embodiment of the technology. The driving shaft 13 may be a rod-shaped member that is mainly rotatable with the use of rotary force of a motor, for example.

In one example, the driving shaft 13 may pass through each of the containing chambers 12A, 12B, and 12C to extend in the X-axis direction.

In other words, the driving shaft 13 may be a single rod-shaped member that extends in the X-axis direction, for example. The driving shaft 13 may penetrate, for example, through the partition walls 11X and 11Y and thereby extend from the containing chamber 12A to the containing chamber 12C across the containing chamber 12B.

One end portion of the driving shaft 13 may penetrate, for example, through the housing 11 and be thereby coupled to an external driving power source. The "driving power source" may be, for example, a rotary device such as a motor, as described above. With this configuration, the driving shaft 13 may be rotatable about a rotational axis J that extends in the X-axis direction.

[Rotary Body]

The plurality of rotary bodies 14 may correspond to "a plurality of rotary members" in one specific but non-limiting embodiment of the technology. The rotary bodies 14 may be members that are mainly rotatable in response to the rotation of the driving shaft 13.

The rotary bodies 14 may be disposed inside the respective containing chambers 12. In this example, the containing section 10 may include, for example, three containing chambers 12, i.e., the containing chambers 12A, 12B, and 12C, as described above. Accordingly, the containing section 10 may include three rotary bodies 14, i.e., rotary bodies 14A, 14B, and 14C.

The rotary body 14A may be disposed inside the containing chamber 12A, for example. The rotary body 14B may be disposed inside the containing chamber 12B, for example. The rotary body 14C may be disposed inside the containing chamber 12C, for example. Thus, the rotary bodies 14A, 14B, and 14C may be partitioned from each other.

The rotary bodies 14A, 14B, and 14C may be provided with through-holes 14AK, 14BK, and 14CK, respectively, and the through-holes 14AK, 14BK, and 14CK may each extend in the X-axis direction. The driving shaft 13 may be in a state inserted in the through-holes 14AK, 14BK, and 14CK and thus extend from the containing chamber 12A to the containing chamber 12C across the containing chamber 12B, as described above.

The rotary bodies 14A, 14B, and 14C may be rotatable in response to the rotation of the driving shaft 13 while the driving shaft 13 is in a state inserted in the through-holes 14AK, 14BK, and 14CK.

However, the angles of rotation of the driving shaft 13 held when the respective rotary bodies 14A, 14B, and 14C start rotating differ from one another, for example. Therefore, the rotary bodies 14A, 14B, and 14C may each start rotating in accordance with a different angle of rotation of the driving shaft 13, for example. With this configuration, the rotary bodies 14A, 14B, and 14C may each be independently rotatable in response to the rotation of the driving shaft 13. Thus, an angle of rotation OA of the driving shaft 13 held when the rotary body 14A starts rotating, an angle of rotation OB of the driving shaft 13 held when the rotary body 14B starts rotating, and an angle of rotation OC of the driving shaft 13 held when the rotary body 14C starts rotating may differ from one another, for example. Accordingly, the rotary bodies 14A, 14B, and 14C may start rotating not at common timing but at timing different from one another in response to the rotation of the driving shaft 13. Therefore, the timing at which the rotary bodies 14A, 14B, and 14C start rotating may differ from one another.

Detailed configurations of the driving shaft 13 and the rotary bodies 14A, 14B, and 14C will be described later with reference to FIG. 5 to FIG. 10.

[Stirring Plates]

The plurality of stirring plates 15 may correspond to "a plurality of stirring members" in one specific but non-limiting embodiment of the technology. The stirring plates 15 may be plate-shaped members that mainly stir the toners of the plurality of colors contained in the respective containing chambers 12. In one example, the stirring plates 15 may be supported by the respective rotary bodies 14 and be pivotable in response to the rotation of the respective rotary bodies 14. In other words, the stirring plates 15 may be movable around the respective rotary bodies 14.

In this example, the containing section 10 may include, for example, three rotary bodies 14, i.e., the rotary bodies 14A, 14B, and 14C, as described above. As such, the containing section 10 may include three stirring plates 15, i.e., stirring plates 15A, 15B, and 15C.

The stirring plate 15A may be disposed inside the containing chamber 12A and supported by the rotary body 14A, for example. The stirring plate 15B may be disposed inside the containing chamber 12B and supported by the rotary body 14B, for example. The stirring plate 15C may be disposed inside the containing chamber 12C and supported by the rotary body 14C, for example. Thus, the stirring plates 15A, 15B, and 15C may be partitioned from each other.

The driving shaft 13 may be so in a state inserted in the through-holes 14AK, 14BK, and 14CK provided in the respective rotary bodies 14A, 14B, and 14C that the phases of the stirring plates 15A, 15B, and 15C in the pivoting direction differ from one another, for example. Therefore, as described above, the angles of rotation of the driving shaft 13 held when the respective rotary bodies 14A, 14B, and 14C start rotating differ from one another, for example. Accordingly, when the stirring plates 15A, 15B, and 15C pivot in response to the rotation of the driving shaft 13, the pivoting positions of the stirring plates 15A, 15B, and 15C held while pivoting may differ from one another. In other words, after the stirring plates 15A, 15B, and 15C start rotating, the pivoting position of the stirring plate 15A, the pivoting position of the stirring plate 15B, and the pivoting position of the stirring plate 15C may differ from one another. As such, the timing at which the respective rotary bodies 14A, 14B, and 14C start rotating may differ from one another, and thus the phases associated with the pivoting positions of the respective stirring plates 15A, 15B, and 15C, i.e., the phases in the pivoting direction, may differ from one another.

The stirring plates 15A, 15B, and 15C may each extend in a direction intersecting the direction in which the driving shaft 13 extends, i.e., the X-axis direction. The direction in which the stirring plates 15A, 15B, and 15C each extend is not particularly limited as long as the stated direction intersects the direction in which driving shaft 13 extends. The direction in which the stirring plates 15A, 15B, and 15C each extend may correspond to a "second direction" in one specific but non-limiting embodiment of the technology.

FIG. 2 to FIG. 4 illustrate a case where the stirring plates 15A, 15B, and 15C each extend in a Z-axis direction, for example. In other words, for example, before the rotary bodies 14A, 14B, and 14C start rotating, the stirring plates 15A, 15B, and 15C may extend in a direction away from the respective discharge ports 16A, 16B, and 16C, for example. Thus, the stirring plates 15A, 15B, and 15C may extend, for example, in a common direction, i.e., the Z-axis direction.

Before the driving shaft 13 starts rotating, the stirring plates 15A, 15B, and 15C may be so disposed as to extend in a common direction, as described above, for example. However, when the rotary bodies 14A, 14B, and 14C start rotating in response to the rotation of the driving shaft 13, the rotary bodies 14A, 14B, and 14C may start rotating at timing different from one another.

The stirring plate 15A may include a plurality of stirrers 15AF arrayed in the X-axis direction, for example, and the stirrers 15AF may be spaced apart from each other, for example. The stirring plate 15B may include a plurality of stirrers 15BF arrayed in the X-axis direction, for example, and the stirrers 15BF may be spaced apart from each other, for example. The stirring plate 15C may include a plurality of stirrers 15CF arrayed in the X-axis direction, for example, and the stirrers 15CF may be spaced apart from each other, for example. The number of the stirrers 15AF, 15BF, and 15CF is not particularly limited as long as two or more each of the stirrers 15AF, 15BF, and 15CF are provided. FIG. 2 to FIG. 4 illustrate a case where five each of the stirrers 15AF, 15BF, and 15CF are provided, for example. The number of the stirrers 15AF, 15BF, and 15CF is not limited to two or more each, and one each of the stirrers 15AF, 15BF, and 15CF may be provided.

The material of the stirring plates 15A, 15B, and 15C is not particularly limited. In one example, the stirring plates 15A, 15B, and 15C may each be a film such as a flexible film including one or more of polymer compounds, for example.

[Shutter]

The shutter 17 may be a plate-shaped member that mainly switches the state of each of the discharge ports 16A, 16B, and 16C, for example, between an open state and a closed state.

The shutter 17 may be provided, for example, on one surface of the housing 11, e.g., on the lower surface of the housing 11 in which the discharge ports 16A, 16B, and 16C are provided. The shutter 17 may be slidable in the X-axis direction.

The shutter 17 may be provided with three openings 17A, 17B, and 17C, for example. The positions where the openings 17A, 17B, and 17C are provided may correspond to the positions of the respective discharge ports 16A, 16B, and 16C.

The shutter 17 may be slidable, for example, between a position, i.e., an open position, at which the openings 17A, 17B, and 17C are continuous with the respective discharge ports 16A, 16B, and 16C and another position, i.e., a closed position, at which the openings 17A, 17B, and 17C are discontinuous from the respective discharge ports 16A, 16B, and 16C.

In a state in which the shutter 17 is located at the open position, the discharge ports 16A, 16B, and 16C may each be open, and thus the toners of the plurality colors may be dischargeable through the respective discharge ports 16A, 16B, and 16C. In contrast, in a state in which the shutter 17 is located at the closed position, the discharge ports 16A, 16B, and 16C may be blocked by the shutter 17, and thus the toners of the plurality of colors may not be dischargeable through the discharge ports 16A, 16B, and 16C. FIG. 3 illustrates a state in which the shutter 17 is located at the open position, and FIG. 4 illustrates a state in which the shutter 17 is located at the closed position.

[1-3. Detailed Configurations of Driving Shaft, Rotary Bodies, and Stirring Plates]

Next, detailed configurations of the driving shaft 13, the rotary bodies 14, i.e., the rotary bodies 14A, 14B, and 14C, and the stirring plates 15, i.e., the stirring plates 15A, 15B, and 15C, will be described.

Figure 5:
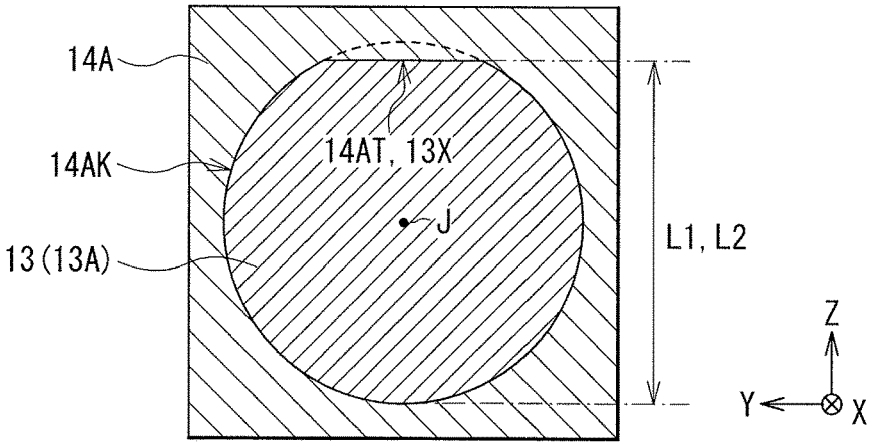
FIG. 5 is a cross-sectional view illustrating an example of a configuration of a main portion, i.e., a driving shaft and a rotary body, of the toner cartridge illustrated in FIG. 3 and FIG. 4.
Figure 6:
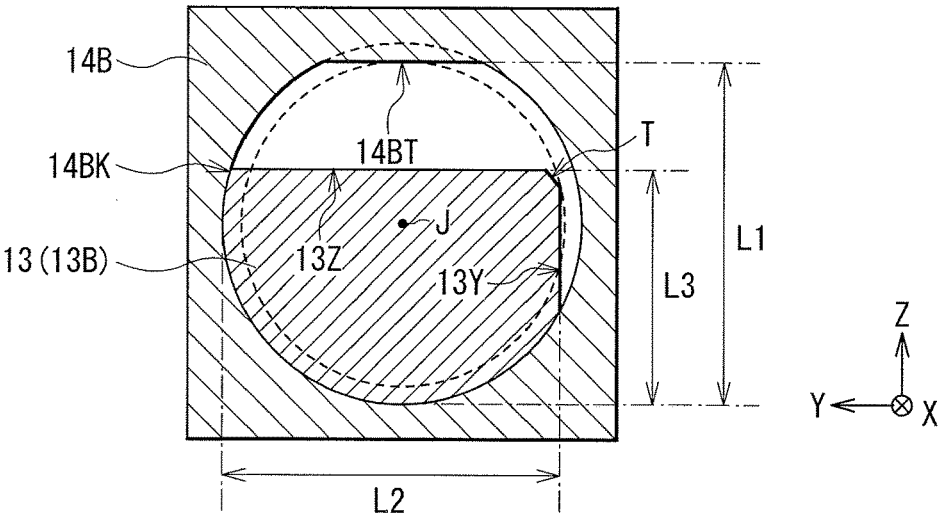
FIG. 6 is a cross-sectional view illustrating an example of a configuration of another main portion, i.e., the driving shaft and another rotary body, of the toner cartridge illustrated in FIG. 3 and FIG. 4.
Figure 7:
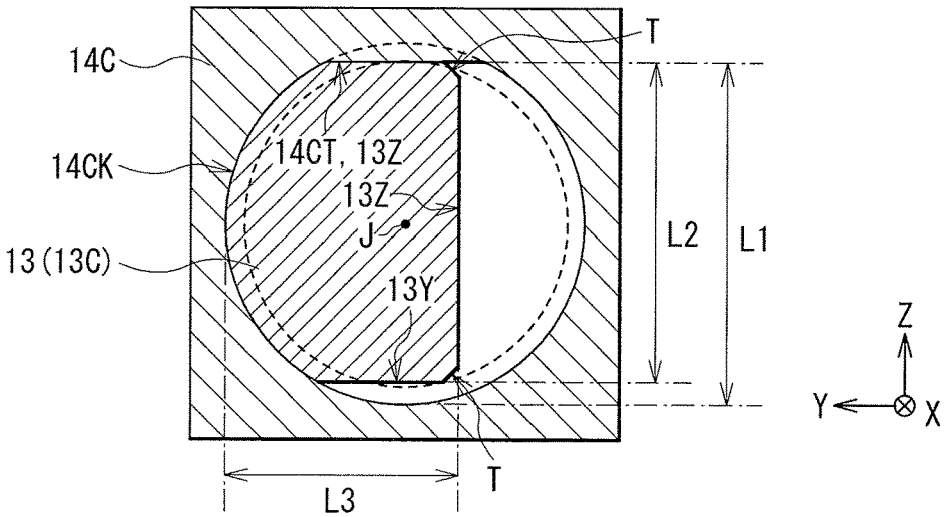
FIG. 7 is a cross-sectional view illustrating an example of a configuration of yet another main portion, i.e., the driving shaft and yet another rotary body, of the toner cartridge illustrated in FIG. 3 and FIG. 4.

FIG. 5 illustrates a cross-sectional configuration of the driving shaft 13 and the rotary body 14A, FIG. 6 illustrates a cross-sectional configuration of the driving shaft 13 and the rotary body 14B, and FIG. 7 illustrates a cross-sectional configuration of the driving shaft 13 and the rotary body 14C. FIG. 5 illustrates a cross section of the driving shaft 13 and the rotary body 14A inside the containing chamber 12A. FIG. 6 illustrates a cross section of the driving shaft 13 and the rotary body 14B inside the containing chamber 12B.

FIG. 7 illustrates a cross section of the driving shaft 13 and the rotary body 14C inside the containing chamber 12C.

Figure 8:
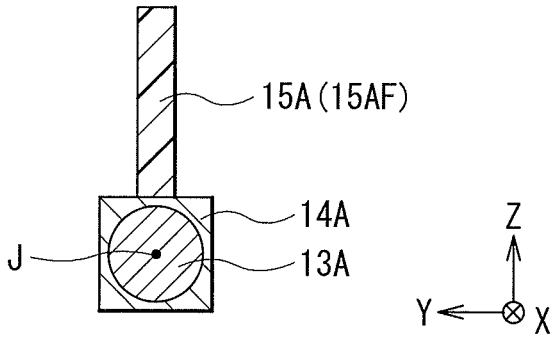
FIG. 8 is a cross-sectional view illustrating an example of a configuration of a main portion, e.g., a stirring plate, of the toner cartridge illustrated in FIG. 3 and FIG. 4.
Figure 9:
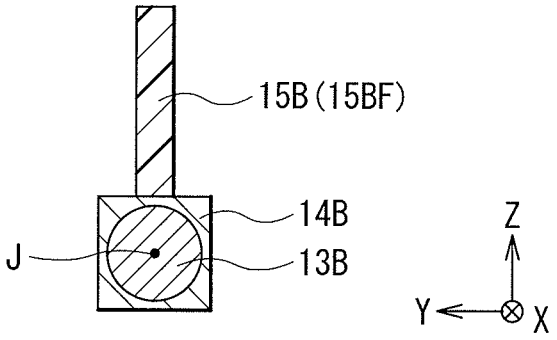
FIG. 9 is a cross-sectional view illustrating an example of a configuration of another main portion, e.g., another stirring plate, of the toner cartridge illustrated in FIG. 3 and FIG. 4.
Figure 10:
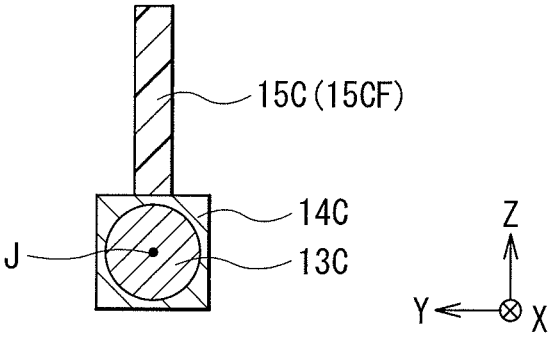
FIG. 10 is a cross-sectional view illustrating an example of a configuration of yet another main portion, e.g., yet another stirring plate, of the toner cartridge illustrated in FIG. 3 and FIG. 4.

FIG. 8 illustrates a cross-sectional configuration of the driving shaft 13, the rotary body 14A, and the stirring plate 15A; FIG. 9 illustrates a cross-sectional configuration of the driving shaft 13, the rotary body 14B, and the stirring plate 15B; and FIG. 10 illustrates a cross-sectional configuration of the driving shaft 13, the rotary body 14C, and the stirring plate 15C. FIG. 8, corresponding to FIG. 5, illustrates a cross section of the driving shaft 13, the rotary body 14A, and the stirring plate 15A inside the containing chamber 12A. FIG. 9, corresponding to FIG. 6, illustrates a cross section of the driving shaft 13, the rotary body 14B, and the stirring plate 15B inside the containing chamber 12B. FIG. 10, corresponding to FIG. 7, illustrates a cross section of the driving shaft 13, the rotary body 14C, and the stirring plate 15C inside the containing chamber 12C.

[Relationship among Angles of Rotation θA, θB, and θC]

As described above, the rotary bodies 14A, 14B, and 14C may each be rotatable in response to the rotation of the driving shaft 13. However, to make the pivoting positions of the respective stirring plates 15A, 15B, and 15C differ from one another, the angles of rotation of the driving shaft 13 held when the respective rotary bodies 14A, 14B, and 14C start rotating may differ from one another, for example. Hereinafter, an assumption is that the driving shaft 13 illustrated in each of FIG. 5 to FIG. 10 rotates counterclockwise about the rotational axis J, for example.

In this example, the relationship among the angle of rotation θA of the driving shaft 13 held when the rotary body 14A starts rotating, the angle of rotation θB of the driving shaft 13 held when the rotary body 14B starts rotating, and the angle of rotation OC of the driving shaft 13 held when the rotary body 14C starts rotating is not particularly limited as long as the angles of rotation θA, θB, and θC differ from one another. Therefore, for example, the angles of rotation θA, θB, and θC may satisfy a relationship in which the angles of rotation θA, θB, and θC are greater in this order, i.e., the relationship of θA<θB<θC. Alternatively, the angles of rotation θA, θB, and θC may satisfy a relationship in which the angles of rotation θA, θB, and θC are smaller in this order, i.e., the relationship of θA>θB>θC. Furthermore, the angles of rotation θA, θB, and θC may satisfy any other relationship.

In this example, a case where the angles of rotation θA, θB, and θC satisfy the relationship in which the angles of rotation θA, θB, and θC are greater in this order, i.e., the relationship of θA<θB<θC, will be described, for example. In a case where the angles of rotation θA, θB, and θC satisfy the stated relationship, for example, once the driving shaft 13 starts rotating, the rotary body 14A may start rotating, and thereafter the rotary body 14B may start rotating. Thereafter, the rotary body 14C may start rotating after the rotary body 14B has started rotating. With this configuration, the stirring plate 15A may start pivoting, and thereafter the stirring plate 15B may start pivoting. Thereafter, the stirring plate 15C may start pivoting after the stirring plate 15B has started pivoting. Therefore, when the stirring plates 15A, 15B, and 15C have all started pivoting, the pivoting positions of the stirring plates 15A, 15B, and 15C may differ from one another.

To make the angles of rotation θA, θB, and θC satisfy the aforementioned relationship, i.e., the relationship of θA<θB<θC, the driving shaft 13 and the rotary bodies 14A, 14B, and 14C may have such a configuration as described below.

In this example, the driving shaft 13 may have a three-dimensional shape that allows the driving shaft 13 to engage with the through-holes 14AK, 14BK, and 14CK provided in the respective rotary bodies 14A, 14B, and 14C at angles of rotation θA, θB, and θC different from one another, for example. Therefore, the angles of rotation θA, θB, and θC at which the driving shaft 13 engages with the through-holes 14AK, 14BK, and 14CK, respectively, may differ from one another.

[Configuration of Rotary Bodies and Their Through-holes]

In one example, the openings of the respective through-holes 14AK, 14BK, and 14CK may have such shapes that include planar engagement portions 14AT, 14BT, and 14CT, respectively, located at positions corresponding to one another, as illustrated in FIG. 5 to FIG. 7, for example. In one specific but non-limiting example, the openings of the respective through-holes 14AK, 14BK, and 14CK may have substantially-circular shapes each having a planar portion. In other words, the openings of the respective through-holes 14AK, 14BK, and 14CK may have a common shape, for example.

The engagement portions 14AT, 14BT, and 14CT may each be a portion that engages with, or comes into contact with, a non-rotating engaging portion 13X and a rotating engaging portion 13Y, described later, of the driving shaft 13. The "shapes of the openings" may be the shapes of the through-holes 14AK, 14BK, and 14CK as viewed in the X-axis direction.

[Configuration of Driving Shaft]

As illustrated in FIG. 3 and FIG. 4, for example, the driving shaft 13 may include an insertion portion 13A in a state inserted in the through-hole 14AK, an insertion portion 13B in a state inserted in the through-hole 14BK, and an insertion portion 13C in a state inserted in the through-hole 14CK.

The cross-sectional shape of the driving shaft 13 at the insertion portion 13A inside the containing chamber 12A, the cross-sectional shape of the driving shaft 13 at the insertion portion 13B inside the containing chamber 12B, and the cross-sectional shape of the driving shaft 13 at the insertion portion 13C inside the containing chamber 12C may differ from one another, for example. The "cross-sectional shape" may be a shape of a cross section of the driving shaft 13 intersecting the X-axis direction, i.e., a shape of a cross section of the driving shaft 13 taken along a YZ-plane.

In one example, the cross-sectional shape of each of the insertion portions 13A, 13B, and 13C may be, for example, one of a first shape and a second shape, which will be described later.

The first shape may be a shape having one non-rotating engaging portion 13X that engages with any one of the engagement portions 14AT, 14BT, and 14CT before the driving shaft 13 starts rotating, for example. The second shape may be a shape not having any non-rotating engaging portion 13X described above but having one or more rotating engaging portions 13Y that are engageable with any one of the engagement portions 14AT, 14BT, and 14CT after the driving shaft 13 starts rotating and one or more non-engaging portions 13Z that are not engageable with any of the engagement portions 14AT, 14BT, and 14CT irrespective of the rotation of the driving shaft 13, for example.

[Configuration 1 of Insertion Portion]

As illustrated in FIG. 5, for example, the cross-sectional shape of the insertion portion 13A may be the first shape having one planar non-rotating engaging portion 13X. Thus, the cross-sectional shape of the insertion portion 13A may be similar to the shape of the opening of the through-hole 14AK, for example.

For example, in the insertion portion 13A, the non-rotating engaging portion 13X may oppose and come into contact with the engagement portion 14AT before the driving shaft 13 starts rotating. Thus, the non-rotating engaging portion 13X is already in engagement with the engagement portion 14AT. In this case, as illustrated in FIG. 8, for example, the stirring plate 15A may be pointed upward, e.g., pointed in a direction away from the discharge port 16A, as illustrated in FIG. 2 to FIG. 4.

With this configuration, upon the driving shaft 13 starting rotating, the rotary body 14A may be rotatable immediately in response to the rotation of the driving shaft 13. Therefore, the rotary body 14A may start rotating immediately in response to the rotation of the insertion portion 13A, and thus the stirring plate 15A may be pivotable immediately in response to the rotation of the rotary body 14A. In this case, the angle of rotation θA of the driving shaft 13 held when the rotary body 14A starts rotating may be 0°, for example.

[Configuration 2 of Insertion Portion]

As illustrated in FIG. 6, for example, the cross-sectional shape of the insertion portion 13B may be the second shape having one planar rotating engaging portion 13Y and one planar non-engaging portion 13Z. Thus, the cross-sectional shape of the insertion portion 13B may differ from the cross-sectional shape of the insertion portion 13A described above.

For example, in the insertion portion 13B, before the driving shaft 13 starts rotating, the non-engaging portion 13Z may oppose and be spaced apart from the engagement portion 14BT, and the rotating engaging portion 13Y may be disposed at a position offset clockwise by 90° from the position where the rotating engaging portion 13Y would oppose the engagement portion 14BT. Thus, the rotating engaging portion 13Y may not come into contact with the engagement portion 14BT. In this case, as illustrated in FIG. 9, for example, the stirring plate 15B may be pointed in a direction similar to the direction in which the stirring plate 15A is pointed.

With this configuration, the rotating engaging portion 13Y may not yet be in engagement with the engagement portion 14BT, and thus the rotary body 14B may not be rotatable immediately even if the driving shaft 13 starts rotating. However, once the rotating engaging portion 13Y engages with the engagement portion 14BT in response to the rotation of the driving shaft 13, the rotary body 14B may become rotatable. The rotary body 14B may rotate in response to the rotation of the insertion portion 13B, and thus the stirring plate 15B may become pivotable in response to the rotation of the rotary body 14B. In this case, the angle of rotation θB of the driving shaft 13 held when the rotary body 14B starts rotating may be 90°, for example.

[Configuration 3 of Insertion Portion]

As illustrated in FIG. 7, for example, the cross-sectional shape of the insertion portion 13C may be the second shape having one rotating engaging portion 13Y and two non-engaging portions 13Z. Thus, the cross-sectional shape of the insertion portion 13C may differ from either of the cross-sectional shapes of the insertion portions 13A and 13B described above.

For example, in the insertion portion 13C, before the driving shaft 13 starts rotating, the first one of the non-engaging portions 13Z may oppose the engagement portion 14CT, and the second one of the non-engaging portions 13Z may be disposed at a position offset clockwise by 90° from the position where the second one of the non-engaging portions 13Z would oppose the engagement portion 14CT. In addition, the rotating engaging portion 13Y may be disposed at a position offset clockwise by 180° from the position where the rotating engaging portion 13Y would oppose the engagement portion 14CT. Thus, the rotating engaging portion 13Y may not come into contact with the engagement portion 14CT. In this case, as illustrated in FIG. 10, for example, the stirring plate 15C may be pointed in a direction similar to the direction in which the stirring plate 15A is pointed.

With this configuration, the rotating engaging portion 13Y may not yet be in engagement with the engagement portion 14CT, and thus the rotary body 14C may not be rotatable immediately even if the driving shaft 13 starts rotating. However, once the rotating engaging portion 13Y engages with the engagement portion 14CT in response to the rotation of the driving shaft 13, the rotary body 14C may become rotatable. The rotary body 14C may rotate in response to the rotation of the insertion portion 13C, and thus the stirring plate 15C may become pivotable in response to the rotation of the rotary body 14C. In this case, the angle of rotation θC of the driving shaft 13 held when the rotary body 14C starts rotating may be 180°, for example. In other words, although the cross-sectional shapes of the insertion portions 13B and 13C are both the second shape, the angles of rotation θB and θC may differ from each other.

[Taper]

The cross-sectional shape of each of the insertion portions 13B and 13C, of which the cross-sectional shapes are both the second shape, may have a taper T at a corner portion. The number of the taper T is not particularly limited. In this example, the cross-sectional shape of the insertion portion 13B may include one taper T, for example, as illustrated in FIG. 6, and the cross-sectional shape of the insertion portion 13C may have two tapers T, for example, as illustrated in FIG. 7. One of the reasons for this is that this configuration may facilitate the rotation of the insertion portion 13B and also facilitate the engagement of the rotating engaging portion 13Y with the engagement portion 14BT in the insertion portion 13B. Another reason for this is that this configuration may facilitate the rotation of the insertion portion 13C and facilitate the engagement of the rotating engaging portion 13Y with the engagement portion 14CT in the insertion portion 13C.

[Dimensional Relationship]

To achieve the difference among the angles of rotation θA, θB, and θC described above, the dimensions of the driving shaft 13, i.e., the insertion portions 13A, 13B, and 13C, and the rotary bodies 14A, 14B, and 14C, i.e., the through-holes 14AK, 14BK, and 14CK, may satisfy a predetermined relationship, for example.

In this example, a series of parameters that influences the angles of rotation θA, θB, and θC may be set as follows.

L1: the dimension of each of the through-holes 14AK, 14BK, and 14CK defined by the respective engagement portions 14AT, 14BT, and 14CT L2: the dimension of each of the insertion portions 13A, 13B, and 13C defined by either of the non-rotating engaging portion 13X and the rotating engaging portion 13Y L3: the dimension of each of the insertion portions 13A, 13B, and 13C defined by the non-engaging portion(s) 13Z Φ1: the maximum diameter of each of the through-holes 14AK, 14BK, and 14CK, which are substantially circular Φ2: the maximum diameter of each of the insertion portions 13A, 13B, and 13C, which are substantially circular, defined by either of the non-rotating engaging portion 13X and the rotating engaging portion 13Y Φ3: the maximum diameter of each of the insertion portions 13A, 13B, and 13C, which are substantially circular, defined by the non-engaging portion(s) 13Z The series of these parameters L1, L2, L3, Φ1, Φ2, and Φ3 may satisfy the following relationships. This may produce the difference among the angles of rotation θA, θB, and θC as in the relationship of θA<θB<θC, and thus the rotary bodies 14A, 14B, and 14C may become rotatable at timing different from one another.

L1≥L2>L3

Φ1≥Φ2>Φ3

L1>Φ3

Φ2>L1

[1-4. Configuration of Toner]

Next, a configuration of the toners will be described.

The yellow toner may include materials such as a yellow colorant, a binder resin, an external additive, a release agent, and an electric charge control agent, for example. The yellow colorant may include one or more of materials such as a yellow pigment, for example, and non-limiting examples of the yellow pigment may include Pigment Yellow 74.

The magenta toner may have a configuration similar to the configuration of the yellow toner except in that the magenta toner may include a magenta colorant in place of the yellow colorant, for example. The magenta colorant may include one or more of materials such as a magenta pigment and a magenta dye, for example, and non-limiting examples of the magenta pigment may include quinacridone.

The cyan toner may have a configuration similar to the configuration of the yellow toner except in that the cyan toner may include a cyan colorant in place of the yellow colorant, for example. The cyan colorant may include one or more of materials such as a cyan pigment and a cyan dye, for example, and non-limiting examples of the cyan pigment may include Phthalocyanine Blue, e.g., C.I. Pigment Blue 15:3.

[1-5. Operation]

Next, an operation of the toner cartridge 100 will be described. In this example, an operation of stirring the toners with the use of the stirring plates 15A, 15B, and 15C will mainly be described.

Figure 11:
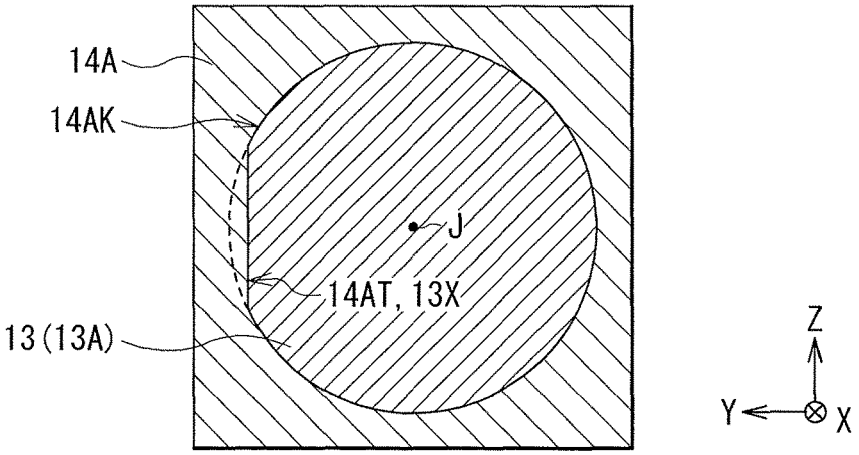
FIG. 11 is a cross-sectional view for describing an example of an operation of the toner cartridge, i.e., the driving shaft and the rotary body, following FIG. 5.
Figure 12:
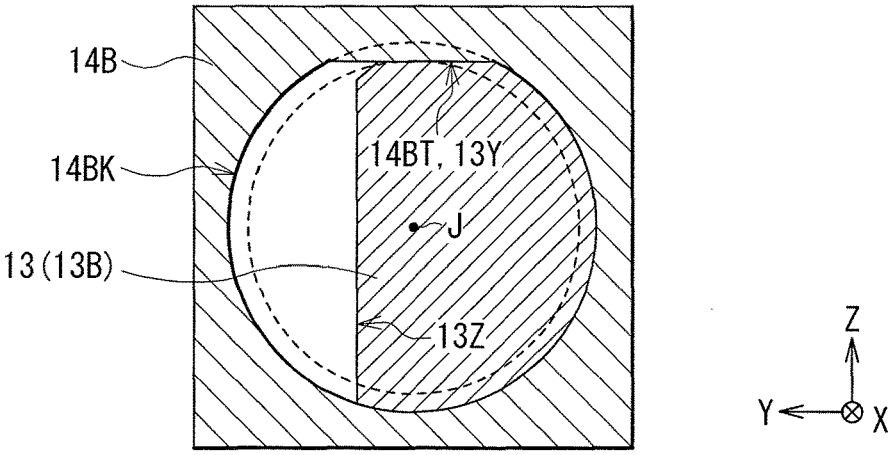
FIG. 12 is a cross-sectional view for describing an example of an operation of the toner cartridge, i.e., the driving shaft and the rotary body, following FIG. 6.
Figure 14:
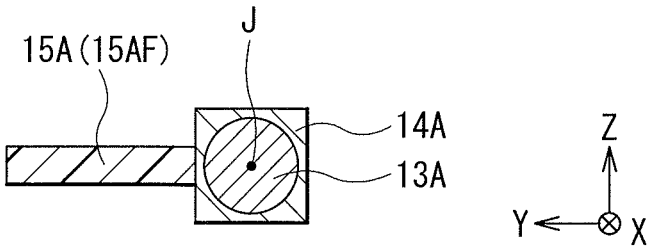
FIG. 14 is a cross-sectional view for describing an example of an operation of the toner cartridge, e.g., the stirring plate, following FIG. 8.
Figure 15:
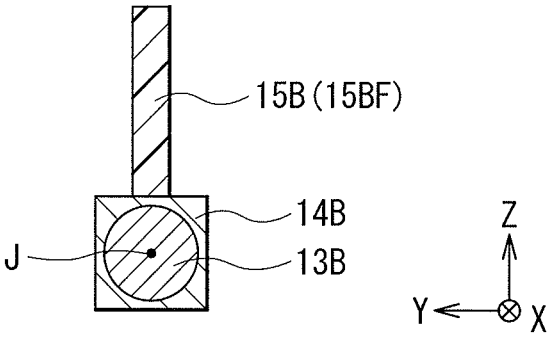
FIG. 15 is a cross-sectional view for describing an example of an operation of the toner cartridge, e.g., the stirring plate, following FIG. 9.
Figure 16:
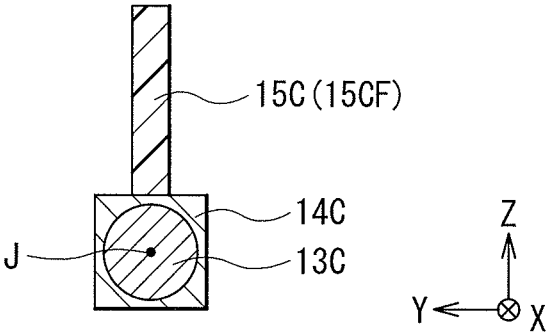
FIG. 16 is a cross-sectional view for describing an example of an operation of the toner cartridge, e.g., the stirring plate, following FIG. 10.
Figure 17:
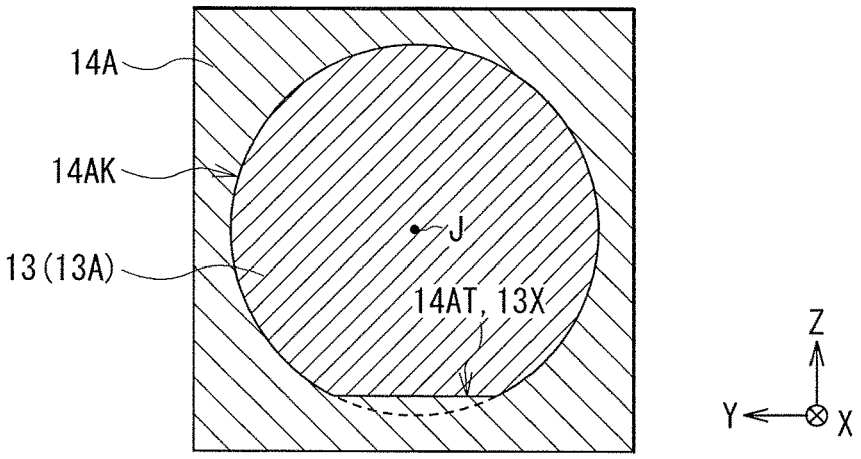
FIG. 17 is a cross-sectional view for describing an example of an operation of the toner cartridge, i.e., the driving shaft and the rotary body, following the operation illustrated in FIG. 11.
Figure 18:
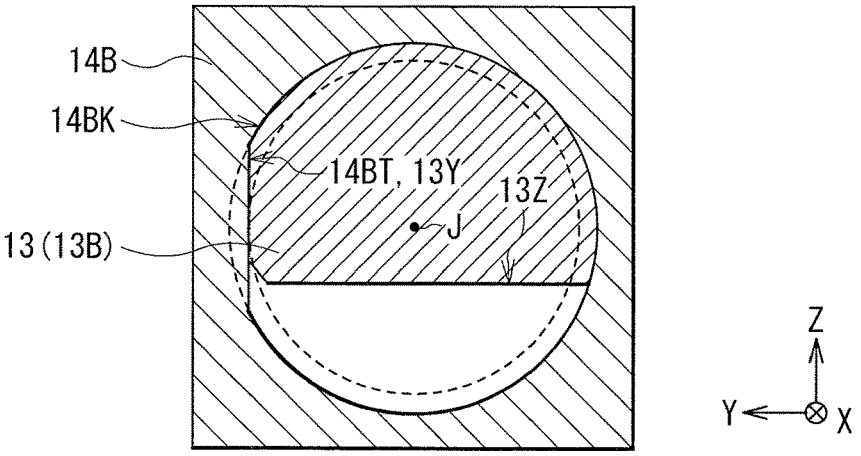
FIG. 18 is a cross-sectional view for describing an example of an operation of the toner cartridge, i.e., the driving shaft and the rotary body, following the operation illustrated in FIG. 12.
Figure 20:
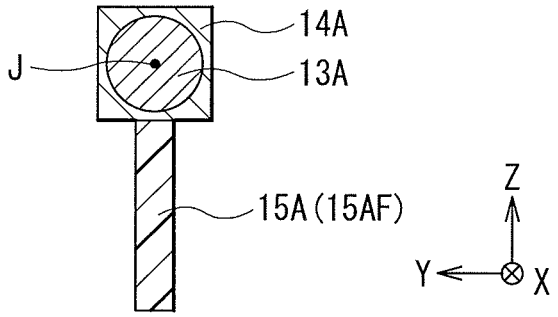
FIG. 20 is a cross-sectional view for describing an example of an operation of the toner cartridge, e.g., the stirring plate, following the operation illustrated in FIG. 14.
Figure 21:
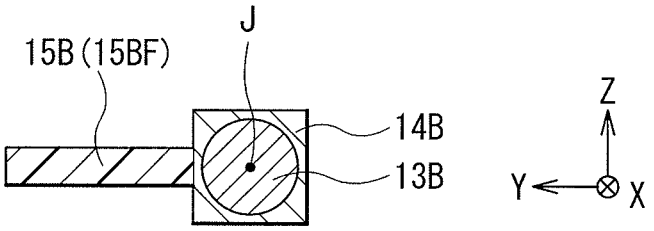
FIG. 21 is a cross-sectional view for describing an example of an operation of the toner cartridge, e.g., the stirring plate, following the operation illustrated in FIG. 15.
Figure 22:
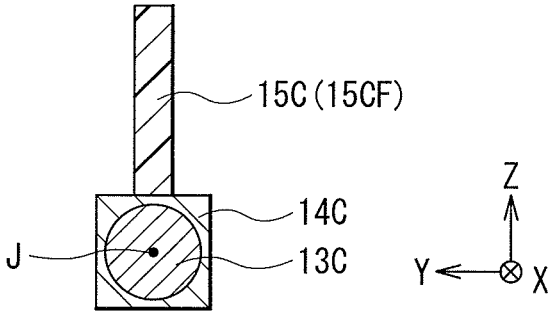
FIG. 22 is a cross-sectional view for describing an example of an operation of the toner cartridge, e.g., the stirring plate, following the operation illustrated in FIG. 16.
Figure 23:
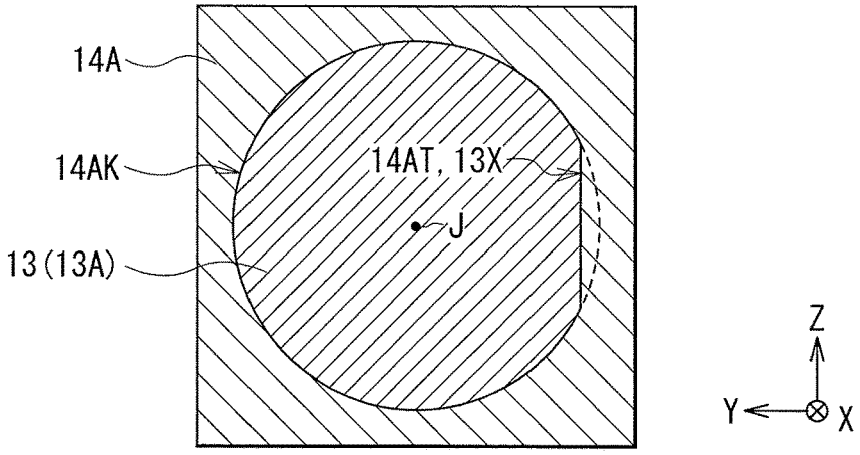
FIG. 23 is a cross-sectional view for describing an example of an operation of the toner cartridge, i.e., the driving shaft and the rotary body, following the operation illustrated in FIG. 17.
Figure 24:
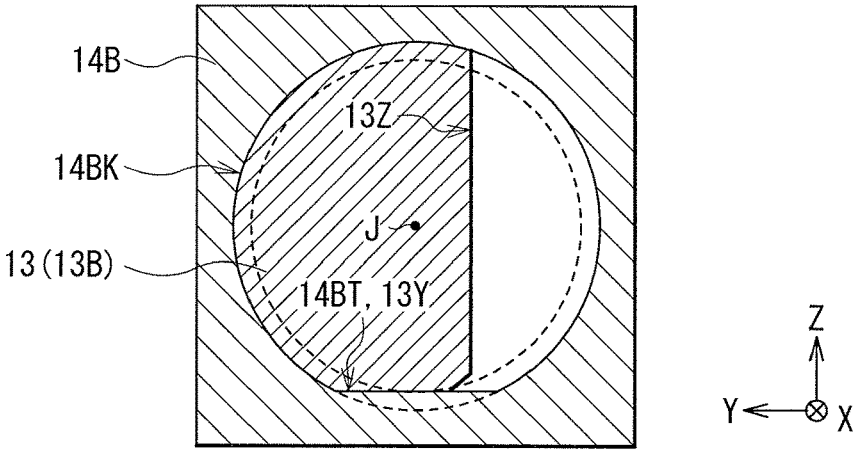
FIG. 24 is a cross-sectional view for describing an example of an operation of the toner cartridge, i.e., the driving shaft and the rotary body, following the operation illustrated in FIG. 18.
Figure 26:
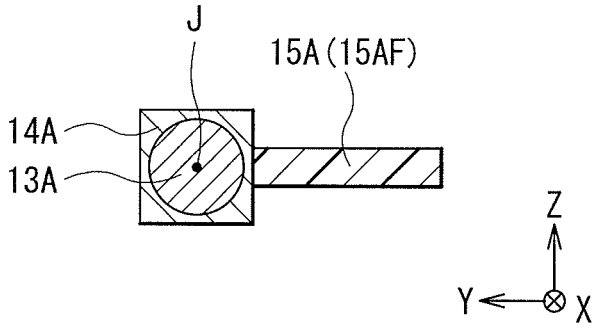
FIG. 26 is a cross-sectional view for describing an example of an operation of the toner cartridge, e.g., the stirring plate, following the operation illustrated in FIG. 20.
Figure 27:
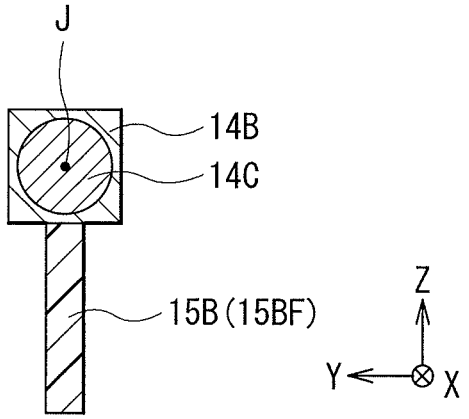
FIG. 27 is a cross-sectional view for describing an example of an operation of the toner cartridge, e.g., the stirring plate, following the operation illustrated in FIG. 21.

To describe an operation of the toner cartridge 100, FIGS. 11, 17, and 23 each illustrate a cross-sectional configuration corresponding to FIG. 5; FIGS. 12, 18, and 24 each illustrate a cross-sectional configuration corresponding to FIG. 6; and FIGS. 13, 19, and 25 each illustrate a cross-sectional configuration corresponding to FIG. 7. To describe an operation of the toner cartridge 100, FIGS. 14, 20, and 26 each illustrate a cross-sectional configuration corresponding to FIG. 8; FIGS. 15, 21, and 27 each illustrate a cross-sectional configuration corresponding to FIG. 9; and FIGS. 16, 22, and 28 each illustrate a cross-sectional configuration corresponding to FIG. 10.

Before the toners are stirred, the driving shaft 13 has not started rotating and is being stopped. In this case, in the insertion portion 13A, the non-rotating engaging portion 13X may be already in engagement with the engagement portion 14AT, as illustrated in FIG. 5, for example. In the insertion portion 13B, the rotating engaging portion 13Y may be disposed at a position offset clockwise by 90° from the position where the rotating engaging portion 13Y would oppose the engagement portion 14BT, as illustrated in FIG. 6, for example. Thus, the rotating engaging portion 13Y may not yet be in engagement with the engagement portion 14BT. In the insertion portion 13C, the rotating engaging portion 13Y may be disposed at a position offset clockwise by 180° from the position where the rotating engaging portion 13Y would oppose the engagement portion 14CT, as illustrated in FIG. 7, for example. Thus, the rotating engaging portion 13Y may not yet be in engagement with the engagement portion 14CT.

In this case, as illustrated in FIG. 8 to FIG. 10, for example, the stirring plates 15A, 15B, and 15C may be pointed in a direction away from the discharge ports 16A, 16B, and 16C, respectively, as illustrated in FIG. 2 to FIG. 4. In one example, the stirring plates 15A, 15B, and 15C may be pointed in a common direction, i.e., the Z-axis direction, for example.

In a case where no toner is contained in the containing chambers 12A, 12B, and 12C before the toners are to be stirred, the shutter 17 may be slid to the open position to open the discharge ports 16A, 16B, and 16C, as illustrated in FIG. 3 and FIG. 4, for example, and the toner may then be placed into each of the containing chambers 12A, 12B, and 12C.

In one example, the yellow toner may be placed into the containing chamber 12A through the discharge port 16A, for example. In addition, the magenta toner may be placed into the containing chamber 12B through the discharge port 16B, for example. Furthermore, the cyan toner may be placed into the containing chamber 12C through the discharge port 16C, for example.

After the toners are placed into the respective containing chambers 12A, 12B, and 12C, the shutter 17 may be slid to the closed position to close the discharge ports 16A, 16B, and 16C.

In a case where the amounts of the toners already contained in the respective containing chambers 12A, 12B, and 12C are low before the toners are to be stirred, the toners may be fed into the respective containing chambers 12A, 12B, and 12C by switching the state of the discharge ports 16A, 16B, and 16C between the open state and the closed state with the use of the shutter 17 described above.

Figure 13:
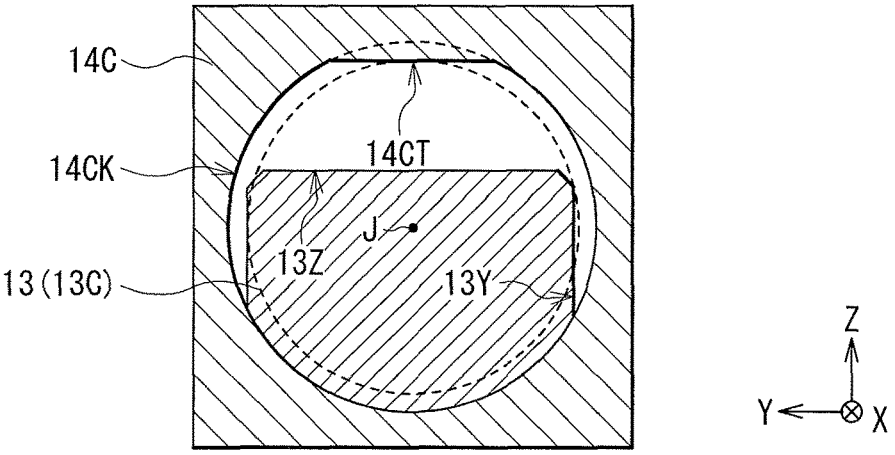
FIG. 13 is a cross-sectional view for describing an example of an operation of the toner cartridge, i.e., the driving shaft and the rotary body, following FIG. 7.

In a case where the toners are to be stirred, first, the driving shaft 13 may be rotated counterclockwise by 90° about the rotational axis J, as illustrated in FIG. 11 to FIG. 13, for example. The total angle of rotation of the driving shaft 13 at this point is 90°.

In this case, in the insertion portion 13A, as described above, since the non-rotating engaging portion 13X is already in engagement with the engagement portion 14AT before the toners are to be stirred, the rotary body 14A may be rotatable immediately in response to the rotation of the insertion portion 13A. Therefore, the rotary body 14A may rotate counterclockwise by 90° in response to the rotation of the driving shaft 13, as illustrated in FIG. 11. Thus, the stirring plate 15A may pivot counterclockwise by 90° in response to the rotation of the rotary body 14A, as illustrated in FIG. 14.

Meanwhile, in the insertion portion 13B, as described above, since the rotating engaging portion 13Y is not yet in engagement with the engagement portion 14BT before the toners are to be stirred, the rotary body 14B may not be rotatable immediately in response to the rotation of the insertion portion 13B. In this case, the insertion portion 13B may rotate with the use of the non-engaging portion 13Z inside the through-hole 14BK, and the rotating engaging portion 13Y may then engage with the engagement portion 14BT. Therefore, the rotary body 14B may not yet start rotating in response to the rotation of the driving shaft 13, as illustrated in FIG. 12. Thus, the stirring plate 15B may not yet pivot, as illustrated in FIG. 15.

Similarly to the insertion portion 13B described above, in the insertion portion 13C, the insertion portion 13C may rotate with the use of the non-engaging portion 13Z inside the through-hole 14CK, and thus the rotary body 14C may not be rotatable immediately in response to the rotation of the insertion portion 13C. Therefore, the rotary body 14C may not yet start rotating in response to the rotation of the driving shaft 13, as illustrated in FIG. 13. Thus, the stirring plate 15C may not yet pivot, as illustrated in FIG. 16.

Figure 19:
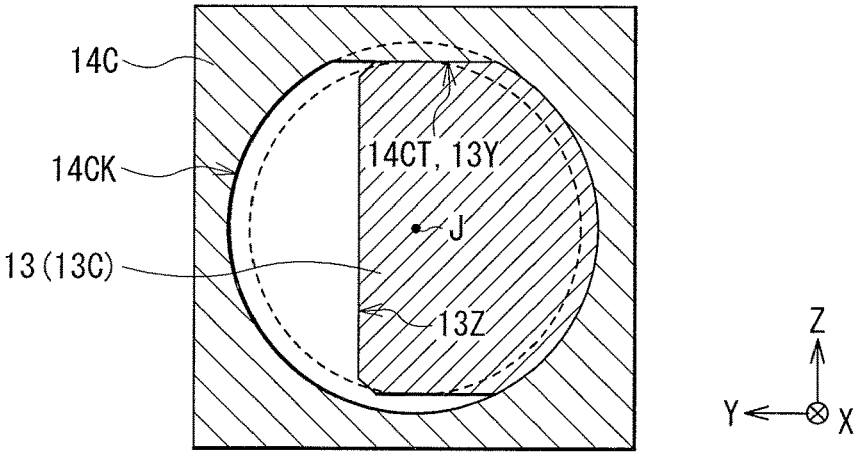
FIG. 19 is a cross-sectional view for describing an example of an operation of the toner cartridge, i.e., the driving shaft and the rotary body, following the operation illustrated in FIG. 13.

Thereafter, the driving shaft 13 may further rotate counterclockwise by 90°, as illustrated in FIG. 17 to FIG. 19, for example. The total angle of rotation of the driving shaft 13 at this point is 180°.

In this case, in the insertion portion 13A, as the non-rotating engaging portion 13X is already in engagement with the engagement portion 14AT, the rotary body 14A may further rotate counterclockwise by 90° in response to the rotation of the driving shaft 13, as illustrated in FIG. 17. Thus, the stirring plate 15A may further pivot counterclockwise by 90° in response to the rotation of the rotary body 14A, as illustrated in FIG. 20.

In addition, in the insertion portion 13B, as described above, since the rotating engaging portion 13Y is already in engagement with the engagement portion 14BT, the rotary body 14B may be rotatable in response to the rotation of the insertion portion 13B. Therefore, the rotary body 14B may rotate counterclockwise by 90° in response to the rotation of the driving shaft 13, as illustrated in FIG. 18. Thus, the stirring plate 15B may pivot counterclockwise by 90° in response to the rotation of the rotary body 14B, as illustrated in FIG. 21.

Meanwhile, in the insertion portion 13C, as described above, since the rotating engaging portion 13Y is not yet in engagement with the engagement portion 14CT, the rotary body 14C may not yet be rotatable in response to the rotation of the insertion portion 13C. In this case, the insertion portion 13C may further rotate with the use of the non-engaging portion 13Z inside the through-hole 14CK, and the rotating engaging portion 13Y may then engage with the engagement portion 14CT. Therefore, the rotary body 14C may not yet start rotating in response to the rotation of the driving shaft 13, as illustrated in FIG. 19. Thus, the stirring plate 15C may not yet pivot, as illustrated in FIG. 22.

Figure 25:
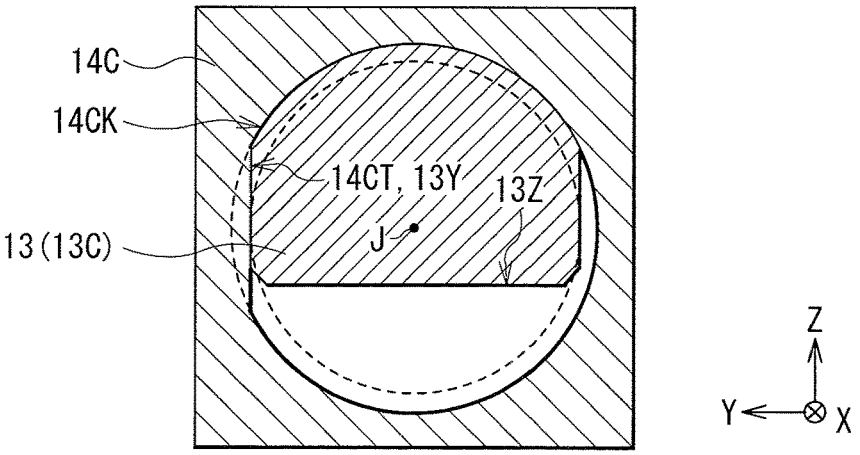
FIG. 25 is a cross-sectional view for describing an example of an operation of the toner cartridge, i.e., the driving shaft and the rotary body, following the operation illustrated in FIG. 19.

Thereafter, the driving shaft 13 may further rotate counterclockwise by 90°, as illustrated in FIG. 23 to FIG. 25, for example. The total angle of rotation of the driving shaft 13 at this point is 270°.

In this case, in the insertion portion 13A, as the non-rotating engaging portion 13X is already in engagement with the engagement portion 14AT, the rotary body 14A may further rotate counterclockwise by 90° in response to the rotation of the driving shaft 13, as illustrated in FIG. 23. Thus, the stirring plate 15A may further pivot counterclockwise by 90° in response to the rotation of the rotary body 14A, as illustrated in FIG. 26.

In addition, in the insertion portion 13B, as the rotating engaging portion 13Y is already in engagement with the engagement portion 14BT, the rotary body 14B may further rotate counterclockwise by 90° in response to the rotation of the driving shaft 13, as illustrated in FIG. 24. Thus, the stirring plate 15B may further pivot counterclockwise by 90° in response to the rotation of the rotary body 14B, as illustrated in FIG. 27.

Figure 28:
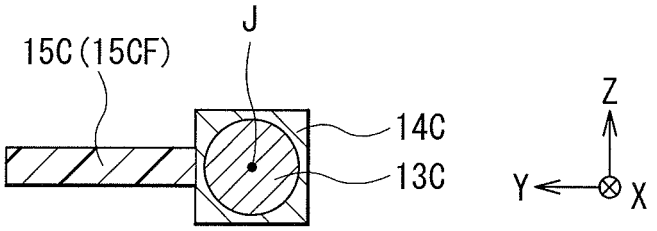
FIG. 28 is a cross-sectional view for describing an example of an operation of the toner cartridge, e.g., the stirring plate, following the operation illustrated in FIG. 22.

Furthermore, in the insertion portion 13C, as described above, since the rotating engaging portion 13Y is already in engagement with the engagement portion 14CT, the rotary body 14C may be rotatable in response to the rotation of the insertion portion 13C. Therefore, the rotary body 14C may rotate counterclockwise by 90° in response to the rotation of the driving shaft 13, as illustrated in FIG. 25. Thus, the stirring plate 15C may pivot counterclockwise by 90° in response to the rotation of the rotary body 14C, as illustrated in FIG. 28.

Thereafter, as the driving shaft 13 further rotates counterclockwise, the rotary bodies 14A, 14B, and 14C may each further rotate counterclockwise in response to the rotation of the driving shaft 13, i.e., the insertion portions 13A, 13B, and 13C. Thus, the stirring plates 15A, 15B, and 15C may each further pivot counterclockwise in response to the rotation of the respective rotary bodies 14A, 14B, and 14C.

As the pivoting operations of the stirring plates 15A, 15B, and 15C described above are repeated, the toners of the plurality of colors contained in the respective containing chambers 12A, 12B, and 12C may be stirred by the stirring plates 15A, 15B, and 15C. In this case, while the stirring plates 15A, 15B, and 15C may extend in the same direction before the driving shaft 13 starts rotating, after the driving shaft 13 starts rotating, the directions in which the stirring plates 15A, 15B, and 15C extend may become different from one another as the rotary bodies 14A, 14B, and 14C start rotating at timings different from one another. With this configuration, as is apparent from FIG. 26 to FIG. 28, a phase difference may be produced among the pivoting positions of the respective stirring plates 15A, 15B, and 15C, and thus the stirring plates 15A, 15B, and 15C may continue to pivot while retaining the stated phase difference.

[1-6. Example Workings and Example Effects]

Next, example workings and example effects of the toner cartridge 100 will be described.

[Main Workings and Effects]

The toner cartridge 100 may include the three containing chambers 12A, 12B, and 12C that contain the respective color toners. In addition, the toner cartridge 100 may include the driving shaft 13, the rotary bodies 14A, 14B, and 14C, and the stirring plates 15A, 15B, and 15C. The driving shaft 13 may extend across each of the containing chambers 12A, 12B, and 12C and be rotatable. The rotary bodies 14A, 14B, and 14C may be disposed inside the containing chambers 12A, 12B, and 12C, respectively, and be rotatable in response to the rotation of the driving shaft 13. The stirring plates 15A, 15B, and 15C may be supported by the rotary bodies 14A, 14B, and 14C, respectively, and be pivotable in response to the rotation of the rotary bodies 14A, 14B, and 14C, respectively. In one example, the pivoting positions of the respective stirring plates 15A, 15B, and 15C held while pivoting may differ from one another. Accordingly, it is possible to form a higher-quality image with the use of the toner cartridge 100 for the reasons described below.

Figure 29:
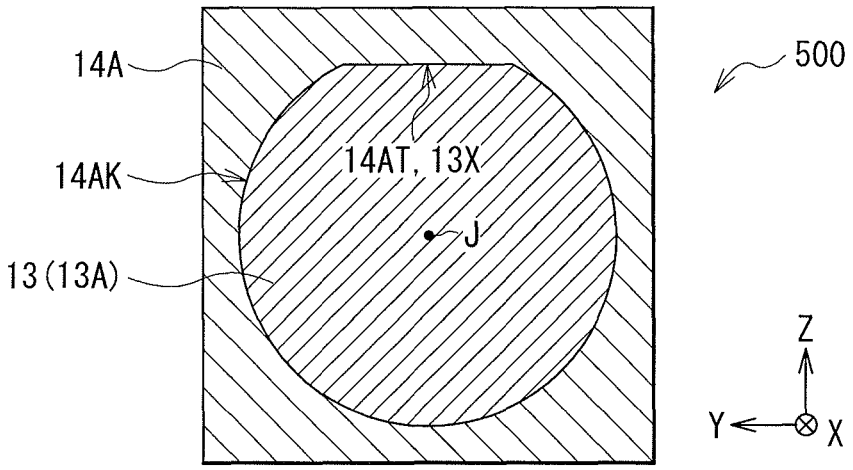
FIG. 29 is a cross-sectional view for describing an example of a configuration and an operation of a main portion, i.e., a driving shaft and a rotary body, of a toner cartridge according to a comparative example.
Figure 30:
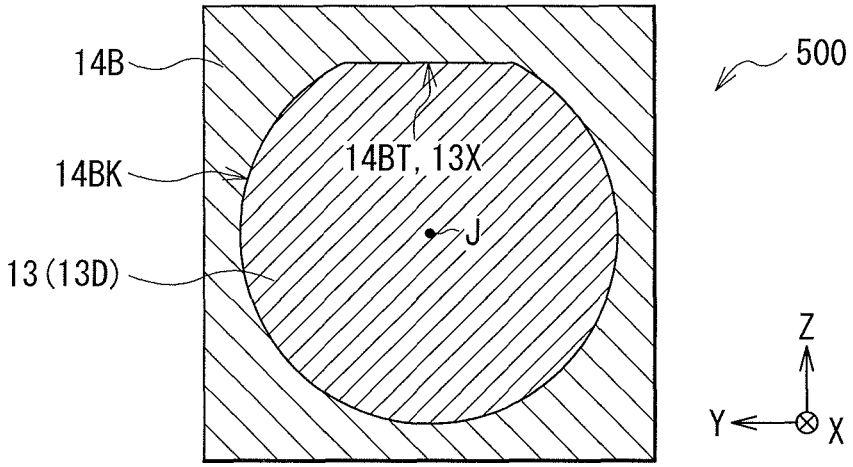
FIG. 30 is a cross-sectional view for describing an example of a configuration and an operation of another main portion, i.e., the driving shaft and another rotary body, of the toner cartridge according to the comparative example.
Figure 31:
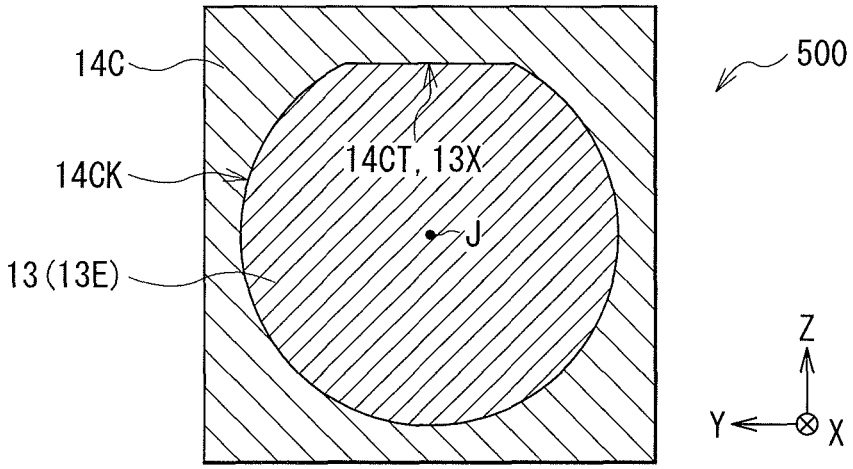
FIG. 31 is a cross-sectional view for describing an example of a configuration and an operation of yet another main portion, i.e., the driving shaft and yet another rotary body, of the toner cartridge according to the comparative example.

To describe a configuration and an operation of a toner cartridge 500 according to a comparative example, FIG. 29 to FIG. 31 illustrate cross-sectional configurations corresponding to FIG. 5 to FIG. 7, respectively. The toner cartridge 500 has a configuration similar to that of the toner cartridge 100 except in that a driving shaft 13 includes insertion portions 13D and 13E in place of the insertion portions 13B and 13C. The insertion portions 13D and 13E each have a configuration similar to that of the insertion portion 13A, for example.

Specifically, the cross-sectional shape of the insertion portion 13D is, for example, the first shape having one planar non-rotating engaging portion 13X, and this non-rotating engaging portion 13X is already in engagement with the engagement portion 14BT before the driving shaft 13 starts rotating. With this configuration, the rotary body 14B is rotatable immediately in response to the rotation of the driving shaft 13. Thus, the stirring plate 15B is pivotable immediately in response to the rotation of the rotary body 14B.

In addition, the cross-sectional shape of the insertion portion 13E is similar to the cross-sectional shape of the insertion portion 13D described above, for example. In other words, the cross-sectional shape of the insertion portion 13E is, for example, the first shape having one planar non-rotating engaging portion 13X, and this non-rotating engaging portion 13X is already in engagement with the engagement portion 14CT before the driving shaft 13 starts rotating. With this configuration, the rotary body 14C is rotatable immediately in response to the rotation of the driving shaft 13. Thus, the stirring plate 15C is pivotable immediately in response to the rotation of the rotary body 14C.

In the toner cartridge 500 according to the comparative example, upon the driving shaft 13 starting rotating, the stirring plates 15A, 15B, and 15C pivot at common timing in response to the rotation of the driving shaft 13. Thus, no phase difference is produced among the pivoting positions of the respective stirring plates 15A, 15B, and 15C.

In this case, the stirring plates 15A, 15B, and 15C come into contact with an inner wall surface of the housing 11 at common timing. Thus, a large load, or stress, is exerted on the driving shaft 13 in association with the contact, and the load easily varies due to, for example, vibrations generated at the time of the contact. This makes it harder for the driving shaft 13 to rotate smoothly and also makes the rotation speed of the driving shaft 13 vary easily. Therefore, it becomes less easy to stir the toners with the use of the stirring plates 15A, 15B, and 15C, and the amount of the toners stirred by the stirring plates 15A, 15B, and 15C varies easily in turn. Accordingly, the stirring operation of the toners becomes unstable, and problems such as aggregation of the toners are more likely to arise. As a result, the amount of the toners fed at the time of forming an image becomes insufficient more easily, and this makes it harder to form a high-quality image.

In contrast, in the toner cartridge 100 according to the present example embodiment, as described above, upon the driving shaft 13 starting rotating, the stirring plates 15A, 15B, and 15C may pivot at timing different from one another in response to the rotation of the driving shaft 13. Thus, a phase difference may be produced among the pivoting positions of the respective stirring plates 15A, 15B, and 15C.

In this case, the stirring plates 15A, 15B, and 15C may come into contact with the inner wall surface of the housing 11 at timing different from one another. Thus, the load exerted on the driving shaft 13 may be reduced, and the load may be less likely to vary. This may make it easier for the driving shaft 13 to rotate smoothly and also make the rotation speed of the driving shaft 13 less likely to vary. Therefore, it may become easier to stir the toners with the use of the stirring plates 15A, 15B, and 15C, and the amount of the toners stirred by the stirring plates 15A, 15B, and 15C may be less likely to vary. Accordingly, the stirring operation of the toners may be stabilized, and problems such as aggregation of the toners may be less likely to arise. As a result, the amount of the toners fed at the time of forming an image may be less likely to become insufficient, and this may thus make it possible to form a higher-quality image.

In the toner cartridge 100 according to the present example embodiment, in one example, the driving shaft 13 may be in a state inserted in the through-holes 14AK, 14BK, and 14CK to make the phases of the stirring plates 15A, 15B, and 15C to differ from one another in the pivoting direction. Thus, if the angles of rotation θA, θB, and θC of the driving shaft 13 differ from one another, it becomes possible to easily achieve a configuration in which the pivoting positions of the respective stirring plates 15A, 15B, and 15C differ from one another by utilizing the simple configuration of the driving shaft 13. Therefore, it is possible to form a higher-quality image with ease.

In addition, in the toner cartridge 100, it is possible to suppress occurrence of a strange sound, e.g., a sliding sound, that could be generated during the stirring operation of the stirring plates 15A, 15B, and 15C.

For example, in the toner cartridge 500 according to the comparative example, the stirring plates 15A, 15B, and 15C come into contact with the inner wall surface of the housing 11 at common timing, and thus the volume of any strange sound generated due to the contact may be greater. In contrast, in the toner cartridge 100 according to the present example embodiment, the stirring plates 15A, 15B, and 15C may come into contact with the inner wall surface of the housing 11 at timing different from one another, and thus the volume of any strange sound generated due to the contact may be smaller.

[Other Workings and Effects]

Aside from the above, in the toner cartridge 100 according to the present example embodiment, if the angles of rotation θA, θB, and θC are gradually greater in this order, a load may be exerted onto the driving shaft 13 sequentially from one end portion to the other end portion of the driving shaft 13. In this case, as compared to the case where the load is exerted randomly onto the driving shaft 13, the rotational axis J may be less likely to fluctuate, and thus the driving shaft 13 may rotate more smoothly and more stably. Accordingly, the rotary bodies 14A, 14B, and 14C may each rotate more smoothly and more stably, which makes it possible to obtain a higher effect. This advantage may be obtained similarly even in a case where the angles of rotation θA, θB, and θC are gradually smaller in this order.

Moreover, if the rotary body 14A includes the plurality of stirrers 15AF, the toner may be stirred by each of the stirrers 15AF. Accordingly, the performance of stirring the toner with the use of the stirring plate 15A may improve, and it is thus possible to obtain a higher effect. This advantage may also be obtained in a case where the rotary body 14B includes the plurality of stirrers 15BF and also in a case where the rotary body 14C includes the plurality of stirrers 15CF.

Moreover, if the stirring plate 15A extends in a direction away from the discharge port 16A before the toners are stirred, i.e., before the driving shaft 13 starts rotating, when the toner is placed or fed into the containing chamber 12A through the discharge port 16A, the stirring plate 15A may be less likely to interfere with this operation. Accordingly, while ensuring that the toner is placed or fed into the containing chamber 12A with ease, the operation of stirring the toner may be stabilized, which thus makes it possible to obtain a higher effect. This advantage may also be obtained in a case where the stirring plates 15B and 15C extend in directions away from the discharge ports 16B and 16C, respectively.

In this case, if the stirring plates 15A, 15B, and 15C extend in a common direction, the stirring plates 15A, 15B, and 15C may be even less likely to interfere with the operation of placing or feeding the toners, which thus makes it possible to obtain an even higher effect.

Moreover, if the stirring plates 15A, 15B, and 15C are so disposed as to extend in a common direction before the driving shaft 13 starts rotating and if the rotary bodies 14A, 14B, and 14C start rotating at timing different from one another upon the driving shaft 13 starting rotating, while ensuring that the toners are placed or fed with ease, the operation of stirring the toners may be stabilized, which thus makes it possible to obtain a higher effect.

Moreover, if the driving shaft 13, i.e., the insertion portions 13A, 13B, and 13C, has such a three-dimensional shape that is engageable with the through-holes 14AK, 14BK, and 14CK at angles of rotation θA, θB, and θC different from one another, a phase difference among the pivoting positions of the respective stirring plates 15A, 15B, and 15C may be produced more easily and more stably by utilizing the three-dimensional shape of the driving shaft 13. Accordingly, the operation of stirring the toners may be stabilized while the phase difference among the pivoting positions is retained, which thus makes it possible to obtain a higher effect.

In this case, for example, if the openings of the through-holes 14AK, 14BK, and 14CK have such shapes that include the engagement portions 14AT, 14BT, and 14CT, respectively, and if the cross-sectional shape of the driving shaft 13, i.e., the insertion portions 13A, 13B, and 13C, is either the first shape having one non-rotating engaging portion 13X or the second shape having one or more rotating engaging portions 13Y and one or more non-engaging portions 13Z, the phase difference among the pivoting positions of the respective stirring plates 15A, 15B, and 15C may be produced more easily and more stably by utilizing the simple difference among the cross-sectional shapes of the insertion portions 13A, 13B, and 13C. Accordingly, the phase difference among the pivoting positions may be retained more easily, which thus makes it possible to obtain an even higher effect.

Moreover, if the cross-sectional shape of the insertion portion 13A is the first shape and the cross-sectional shapes of the insertion portions 13B and 13C are both the second shape and if the cross-sectional shapes of the insertion portions 13B and 13C, which are both the second shape, differ from each other, although the cross-sectional shape of each of the insertion portions 13B and 13C is the second shape, the phase difference between the pivoting positions of the respective stirring plates 15B and 15C may be produced more easily and more stably. Accordingly, the phase difference among the pivoting positions may be retained even more easily, which thus makes it possible to obtain a notably higher effect.

[1-7. Modification Examples]

It is possible to modify the configuration of the toner cartridge 100, as appropriate.

[First Modification Example]

Figure 32:
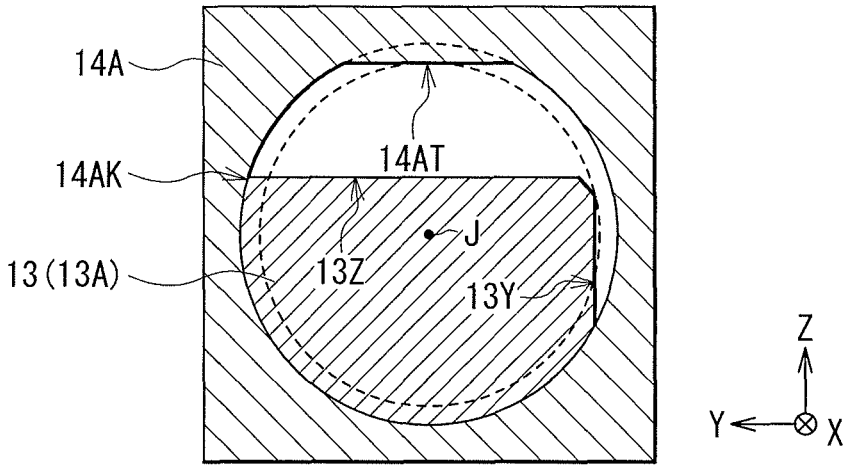
FIG. 32 is a cross-sectional view illustrating a first modification example concerning a configuration of a main portion, i.e., a driving shaft and a rotary body, of a toner cartridge.
Figure 33:
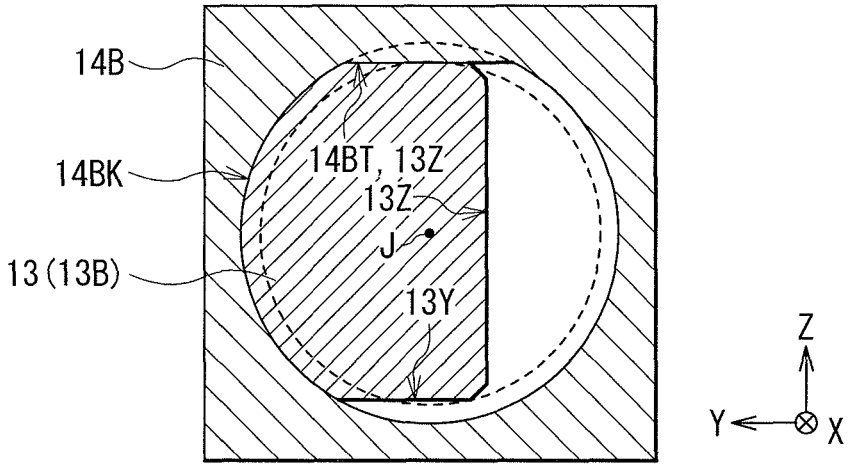
FIG. 33 is a cross-sectional view illustrating the first modification example concerning a configuration of another main portion, i.e., the driving shaft and another rotary body, of the toner cartridge.
Figure 34:
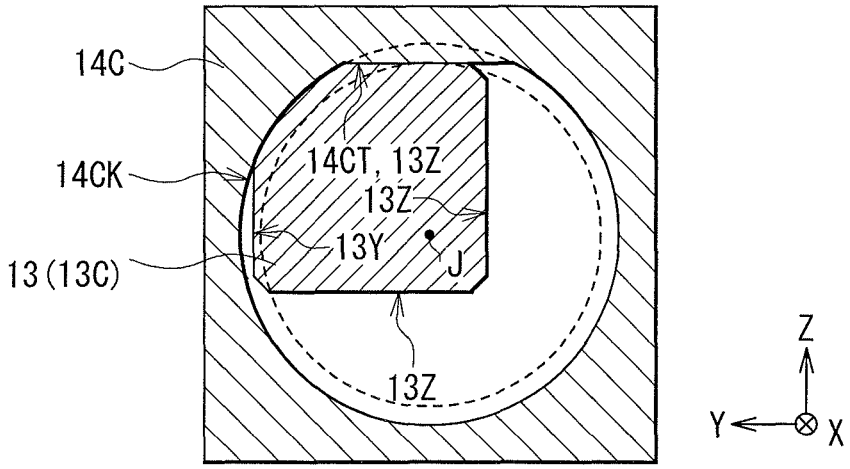
FIG. 34 is a cross-sectional view illustrating the first modification example concerning a configuration of yet another main portion, i.e., the driving shaft and yet another rotary body, of the toner cartridge.

For example, as illustrated in FIG. 32 to FIG. 34, corresponding to FIG. 5 to FIG. 7, respectively, the cross-sectional shape of each of the insertion portions 13A, 13B, and 13C may be modified.

The cross-sectional shape of the insertion portion 13A illustrated in FIG. 32 may be similar to the cross-sectional shape of the insertion portion 13B illustrated in FIG. 6, for example. In other words, the cross-sectional shape of the insertion portion 13A may be, for example, the second shape having one planar rotating engaging portion 13Y and one planar non-engaging portion 13Z. Before the driving shaft 13 starts rotating, the non-engaging portion 13Z may, for example, oppose the engagement portion 14AT, and the rotating engaging portion 13Y may, for example, be disposed at a position offset clockwise by 90° from the position where the rotating engaging portion 13Y would oppose the engagement portion 14AT.

The cross-sectional shape of the insertion portion 13B illustrated in FIG. 33 may be similar to the cross-sectional shape of the insertion portion 13C illustrated in FIG. 7, for example. In other words, the cross-sectional shape of the insertion portion 13B may be, for example, the second shape having one planar rotating engaging portion 13Y and two planar non-engaging portions 13Z. Before the driving shaft 13 starts rotating, the first one of the non-engaging portions 13Z may, for example, oppose the engagement portion 14BT, and the second one of the non-engaging portions 13Z may, for example, be disposed at a position offset clockwise by 90° from the position where the non-engaging portion 13Z would oppose the engagement portion 14BT. In addition, the rotating engaging portion 13Y may, for example, be disposed at a position offset clockwise by 180° from the position where the rotating engaging portion 13Y would oppose the engagement portion 14BT.

The cross-sectional shape of the insertion portion 13C illustrated in FIG. 34 may be, for example, the second shape having one planar rotating engaging portion 13Y and three planar non-engaging portions 13Z. Before the driving shaft 13 starts rotating, the first one of the non-engaging portions 13Z may, for example, oppose the engagement portion 14CT, the second one of the non-engaging portions 13Z may, for example, be disposed at a position offset clockwise by 90° from the position where the non-engaging portion 13Z would oppose the engagement portion 14CT, and the third one of the non-engaging portions 13Z may, for example, be disposed at a position offset clockwise by 180° from the position where the non-engaging portion 13Z would oppose the engagement portion 14CT. The rotating engaging portion 13Y may, for example, be disposed at a position offset clockwise by 270° from the position where the rotating engaging portion 13Y would oppose the engagement portion 14CT.

In the case illustrated in FIG. 32 to FIG. 34, except that the angles of rotation θA, θB, and θC are each increased by 90°, similarly to the case illustrated in FIG. 5 to FIG. 7, the rotary bodies 14A, 14B, and 14C may start rotating at timing different from one another.

In one example, upon the driving shaft 13 having rotated counterclockwise by 90° and then further rotated counterclockwise by 90°, the rotating engaging portion 13Y may engage with the engagement portion 14AT in the insertion portion 13A. With this configuration, the rotary body 14A may rotate counterclockwise by 90° in response to the rotation of the insertion portion 13A. Thus, the stirring plate 15A may pivot counterclockwise by 90° in response to the rotation of the rotary body 14A. In this case, the rotating engaging portion 13Y may engage with the engagement portion 14BT in the insertion portion 13B. Meanwhile, neither of the rotary bodies 14*b* and 14C may yet be rotatable.

Thereafter, upon the driving shaft 13 having further rotated counterclockwise by 90°, the rotary body 14A may further rotate counterclockwise by 90° in response to the rotation of the insertion portion 13A. Thus, the stirring plate 15A may further pivot counterclockwise by 90° in response to the rotation of the rotary body 14A. In addition, as the rotating engaging portion 13Y is in engagement with the engagement portion 14BT in the insertion portion 13B, the rotary body 14B may rotate counterclockwise by 90° in response to the rotation of the insertion portion 13B. Thus, the stirring plate 15B may pivot counterclockwise by 90° in response to the rotation of the rotary body 14B. In this case, the rotating engaging portion 13Y may engage with the engagement portion 14CT in the insertion portion 13C. Meanwhile, the rotary body 14C may not yet be rotatable.

Thereafter, upon the driving shaft 13 having further rotated counterclockwise by 90°, the rotary body 14A may further rotate counterclockwise by 90° in response to the rotation of the insertion portion 13A. Thus, the stirring plate 15A may further pivot counterclockwise by 90° in response to the rotation of the rotary body 14A. In addition, the rotary body 14B may further rotate counterclockwise by 90° in response to the rotation of the insertion portion 13B. Thus, the stirring plate 15B may further pivot counterclockwise by 90° in response to the rotation of the rotary body 14B. Furthermore, as the rotating engaging portion 13Y is in engagement with the engagement portion 14CT in the insertion portion 13C, the rotary body 14C may rotate counterclockwise by 90° in response to the rotation of the insertion portion 13C. Thus, the stirring plate 15C may pivot counterclockwise by 90° in response to the rotation of the rotary body 14C.

Thereafter, as the driving shaft 13 further rotates counterclockwise, the rotary bodies 14A, 14B, and 14C may further rotate counterclockwise in response to the rotation of the insertion portions 13A, 13B, and 13C, respectively. Thus, the stirring plates 15A, 15B, and 15C may further pivot counterclockwise in response to the rotation of the rotary bodies 14A, 14B, and 14C, respectively.

Accordingly, also in the case illustrated in FIG. 32 to FIG. 34, the stirring plates 15A, 15B, and 15C may each pivot while retaining the phase difference among the pivoting positions. Thus, it is possible to obtain a similar effect.

[Second Modification Example]

As described above, the configuration of each of the insertion portions 13A, 13B, and 13C and the rotary bodies 14A, 14B, and 14C is not particularly limited as long as the angles of rotation θA, θB, and θC obtained when the insertion portions 13A, 13B, and 13C engage with the rotary bodies 14A, 14B, and 14C, respectively, differ from one another.

Figure 35:
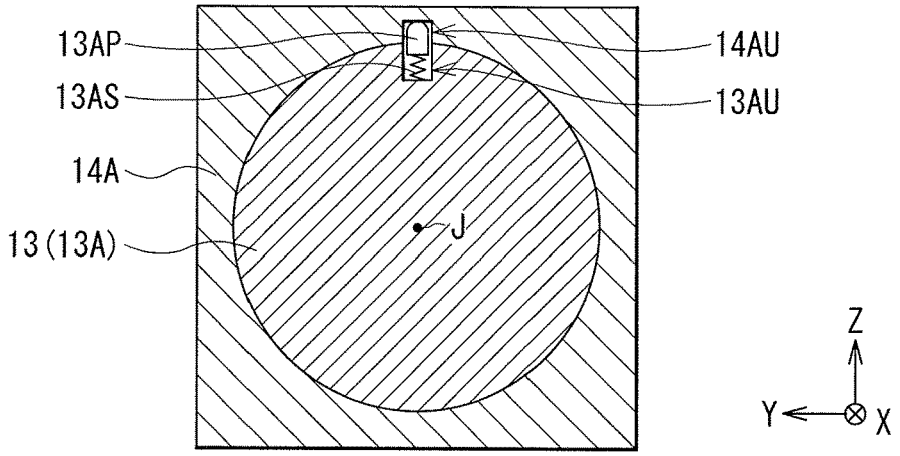
FIG. 35 is a cross-sectional view illustrating a second modification example concerning a configuration of a main portion, i.e., a driving shaft and a rotary body, of a toner cartridge.
Figure 36:
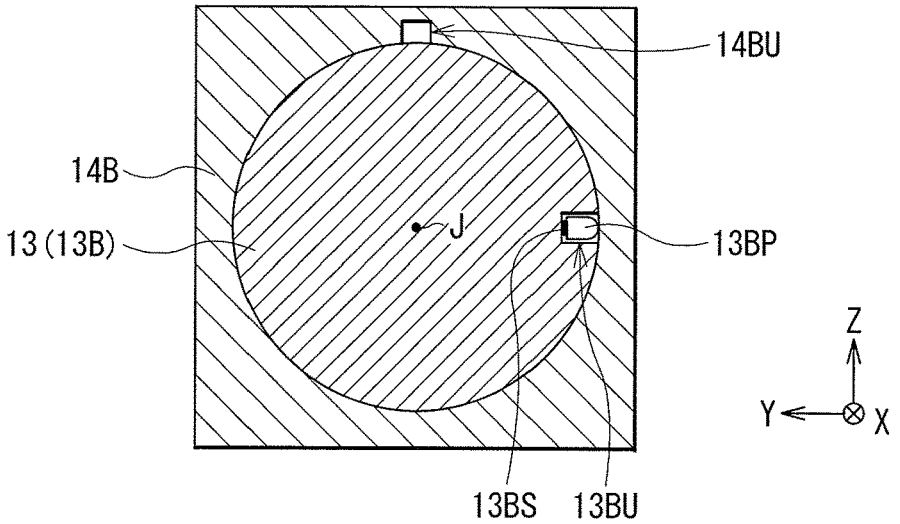
FIG. 36 is a cross-sectional view illustrating the second modification example concerning a configuration of the main portion, i.e., the driving shaft and the rotary body, of the toner cartridge.
Figure 37:
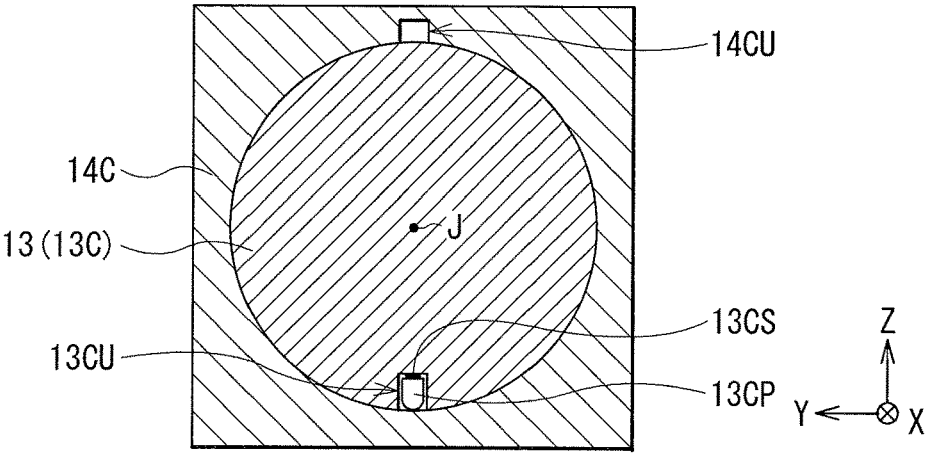
FIG. 37 is a cross-sectional view illustrating the second modification example concerning a configuration of the main portion, i.e., the driving shaft and the rotary body, of the toner cartridge.

In one example, as illustrated in FIG. 35 to FIG. 37, corresponding to FIG. 5 to FIG. 7, respectively, the configuration of each of the insertion portions 13A, 13B, and 13C and the rotary bodies 14A, 14B, and 14C may be modified. FIG. 35 to FIG. 37 illustrate a state held before the driving shaft 13 starts rotating.

In the rotary bodies 14A, 14B, and 14C, as illustrated in FIG. 35 to FIG. 37, for example, recesses 14AU, 14BU, and 14CU may be provided at positions corresponding to the engagement portions 14AT, 14BT, and 14CT, respectively.

As illustrated in FIG. 35, for example, in the insertion portion 13A, a recess 13AU may be provided at a position corresponding to the recess 14AU, and a substantially-cylindrical pin 13AP and a spring 13AS may be housed inside the recess 13AU. The pin 13AP may be urged in such a direction that causes the pin 13AP to project from the recess 13AU via the spring 13AS, for example. FIG. 35 illustrates a state in which the pin 13AP is already partially being inserted in the recess 14AU before the driving shaft 13 starts rotating.

The insertion portions 13B and 13C may each have a configuration similar to that of the insertion portion 13A described above except in that the position where a recess 13BU or a recess 13CU is provided is different, for example.

In other words, as illustrated in FIG. 36, for example, in the insertion portion 13B, the recess 13BU may be provided at a position offset clockwise by 90° from the position where the recess 13BU would oppose the recess 14BU, and a pin 13BP and a spring 13BS may be housed inside the recess 13BU. FIG. 36 illustrates a state in which the pin 13BP has not yet been inserted in the recess 14BU before the driving shaft 13 starts rotating.

In addition, as illustrated in FIG. 37, for example, in the insertion portion 13C, the recess 13CU may be provided at a position offset clockwise by 180° from the position where the recess 13CU would oppose the recess 14CU, and a pin 13CP and a spring 13CS may be housed inside the recess 13CU. FIG. 37 illustrates a state in which the pin 13CP has not yet been inserted in the recess 14CU before the driving shaft 13 starts rotating.

In the case illustrated in FIG. 35 to FIG. 37, when the driving shaft 13 rotates counterclockwise by 90°, since the pin 13AP is partially being inserted in the recess 14AU in the insertion portion 13A, the insertion portion 13A may be in engagement with the rotary body 14A. With this configuration, the rotary body 14A may rotate counterclockwise by 90°, and thus the stirring plate 15A may pivot counterclockwise by 90°. In this case, the pin 13BP may be partially inserted into the recess 14BU in the insertion portion 13B, and thus the insertion portion 13B may engage with the rotary body 14B. Meanwhile, in the insertion portions 13B and 13C, neither of the rotary bodies 14B and 14C may yet be rotatable.

Thereafter, when the driving shaft 13 further rotates counterclockwise by 90°, the stirring plate 15A may further pivot in response to the rotation of the rotary body 14A. In addition, as described above, since the insertion portion 13B is in engagement with the rotary body 14B, the stirring plate 15B may pivot in response to the rotation of the rotary body 14B. In this case, the pin 13CP may be partially inserted into the recess 14CU in the insertion portion 13C, and thus the insertion portion 13C may engage with the rotary body 14C. Meanwhile, in the insertion portion 13C, the rotary body 14C may not yet be rotatable.

Thereafter, when the driving shaft 13 further rotates counterclockwise by 90°, the stirring plate 15A may further pivot in response to the rotation of the rotary body 14A, and the stirring plate 15B may further pivot in response to the rotation of the rotary body 14B. In addition, as described above, since the insertion portion 13C is in engagement with the rotary body 14C, the stirring plate 15C may pivot in response to the rotation of the rotary body 14C.

Thereafter, as the driving shaft 13 further rotates counterclockwise, the rotary bodies 14A, 14B, and 14C may rotate counterclockwise, and thus the stirring plates 15A, 15B, and 15C may further pivot counterclockwise.

Accordingly, also in the case illustrated in FIG. 35 to FIG. 37, the stirring plates 15A, 15B, and 15C may each pivot while retaining the phase difference among the pivoting positions, and thus it is possible to obtain a similar effect.

[Third Modification Example]

Figure 38:
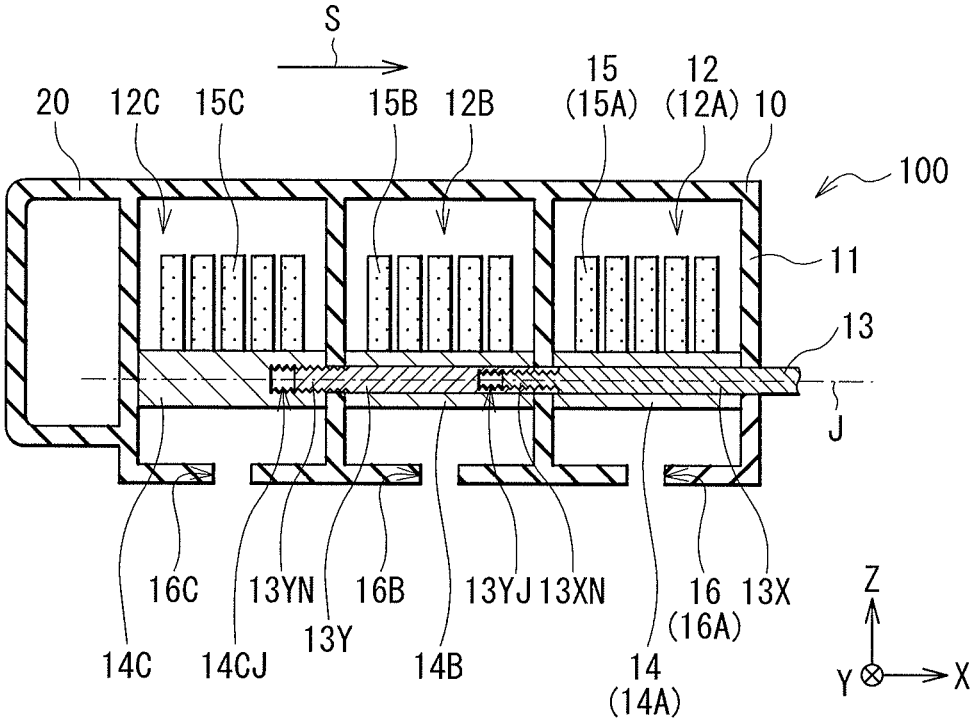
FIG. 38 is a cross-sectional view illustrating a third modification example concerning a configuration of a toner cartridge.

Moreover, as illustrated in FIG. 38, corresponding to FIG. 3 and FIG. 4, for example, the configuration of each of the driving shaft 13 and the rotary bodies 14A, 14B, and 14C may be modified. FIG. 38 illustrates a state held before the driving shaft 13 starts rotating, and the shutter 17 is omitted from the drawing. The driving shaft 13 may include two shaft portions 13X and 13Y that are discontinuous from each other, for example.

For example, the shaft portion 13X may extend midway into the containing chamber 12B from the containing chamber 12A and include a screw portion 13XN provided at an end portion that is closer to the containing chamber 12B than to the containing chamber 12A. The shaft portion 13X may be coupled, for example, to the rotary body 14A, and thus the rotary body 14A may be rotatable along with the shaft portion 13X, for example.

The shaft portion 13Y may extend midway into the containing chamber 12C from the containing chamber 12B, for example. The shaft portion 13Y may include, for example, a screw portion 13YN provided at an end portion that is closer to the containing chamber 12C than to the containing chamber 12B. The shaft portion 13Y may also include a screw hole 13YJ provided at the end portion that is closer to the containing chamber 12B than to the containing chamber 12C. The screw portion 13XN may be being inserted midway in the screw hole 13YJ, for example. The shaft portion 13Y may be coupled, for example, to the rotary body 14B, and thus the rotary body 14B may be rotatable along with the shaft portion 13Y, for example.

The rotary body 14C may include a screw hole 14CJ provided at an end portion that is closer to the containing chamber 12B than to the containing chamber 12C, for example. The screw portion 13YN may be being inserted midway into the screw hole 14CJ, for example.

In the case illustrated in FIG. 38, the shaft portion 13X may be coupled to the rotary body 14A, and thus the shaft portion 13X may be in engagement with the rotary body 14A. With this configuration, when the shaft portion 13X rotates counterclockwise, the rotary body 14A may rotate counterclockwise. Thus, the stirring plate 15A may pivot counterclockwise.

In this case, since the screw portion 13XN is being fitted only midway into the screw hole 13YJ, the screw portion 13XN may rotate inside the screw hole 13YJ for a certain period of time after the driving shaft 13 starts rotating. Therefore, even if the shaft portion 13Y is being coupled to the rotary body 14B, neither the shaft portion 13Y nor the rotary body 14B may yet be rotatable.

In addition, as the screw portion 13XN rotates inside the screw hole 13YJ, the rotation of the shaft portion 13X may not be transmitted to the rotary body 14C, and thus the rotary body 14C may not yet be rotatable.

Thereafter, when the shaft portion 13X rotates until the screw portion 13XN comes into contact with the bottom of the screw hole 13YJ, as the shaft portion 13Y is coupled to the rotary body 14B, the shaft portion 13X may engage indirectly with the rotary body 14B. Thus, the rotary body 14B may become rotatable in response to the rotation of the shaft portion 13X. With this configuration, the rotary body 14A may further rotate counterclockwise, and thus the stirring plate 15A may further pivot counterclockwise. In addition, the rotary body 14B may rotate counterclockwise, and thus the stirring plate 15B may pivot counterclockwise.

In this case, since the screw portion 13YN rotates inside the screw hole 14CJ, the rotation of the shaft portion 13Y may not be transmitted to the rotary body 14C, and thus the rotary body 14C may not yet be rotatable.

Thereafter, when the shaft portion 13Y rotates until the screw portion 13YN comes into contact with the bottom of the screw hole 14CJ, the shaft portion 13Y may engage indirectly with the rotary body 14C, and thus the rotary body 14C may become rotatable in response to the rotation of the shaft portion 13Y. With this configuration, the rotary body 14A may further rotate counterclockwise, and thus the stirring plate 15A may further pivot counterclockwise. The rotary body 14B may further rotate counterclockwise, and thus the stirring plate 15B may further pivot counterclockwise. In addition, the rotary body 14C may rotate counterclockwise, and thus the stirring plate 15C may pivot counterclockwise.

Thereafter, when the shaft portions 13X and 13Y each further rotate counterclockwise, the rotary bodies 14A, 14B, and 14C may each further rotate counterclockwise, and the stirring plates 15A, 15B, and 15C each may further pivot counterclockwise.

Accordingly, also in the case illustrated in FIG. 38, the stirring plates 15A, 15B, and 15C may each pivot while retaining the phase difference among the pivoting positions, and thus it is possible to obtain a similar effect.

[Fourth Modification Example]

A case where the containing section 10 includes three containing chambers 12 has been described. However, as described above, as long as there are two or more containing chambers 12, the number of the containing chambers 12 is not particularly limited. In one example, in a case where toners of four colors are used, for example, four containing chambers 12 may be provided. In this case, toners such as a yellow toner, a magenta toner, a cyan toner, and a black toner may be used, for example. Alternatively, in a case where toners of five colors are used, for example, five containing chambers 12 may be provided. In this case, toners such as a yellow toner, a magenta toner, a cyan toner, a black toner, and a white toner may be used, for example.

In this manner, also in a case where the number of the containing chambers 12 is modified, the stirring plates 15A, 15B, and 15C may each pivot while retaining the phase difference among the pivoting positions, and thus it is possible to obtain a similar effect.

[Fifth Modification Example]

The plurality of stirrers 15AF may be spaced apart from each other in the foregoing example. Alternatively, for example, the stirrers 15AF may be disposed adjacent to each other without any gap therebetween, or adjacent stirrers 15AF of the plurality of stirrers 15AF may partially overlap each other. The configuration of the plurality of stirrers 15AF described in this example may also be applicable to the configuration of the plurality of stirrers 15BF and the configuration of the plurality of stirrers 15CF.

Also in a case where the configurations of the plurality of stirrers 15AF, the plurality of stirrers 15BF, and the plurality of stirrers 15CF are modified in this manner, the stirring plates 15A, 15B, and 15C may each pivot while retaining the phase difference among the pivoting positions, and thus it is possible to obtain a similar effect.

[2. Image Forming Unit]

Next, an image forming unit according to one example embodiment of the technology will be described, and the toner container described above is used in the image forming unit. References will be made below to the constituent elements of the toner cartridge 100 described above as appropriate.

[2-1. Configuration]

First, a configuration of an image forming unit 200, serving as an example of the image forming unit, will be described. References will be made below to the constituent elements of the toner cartridge 100 described above as appropriate.

Figure 39:
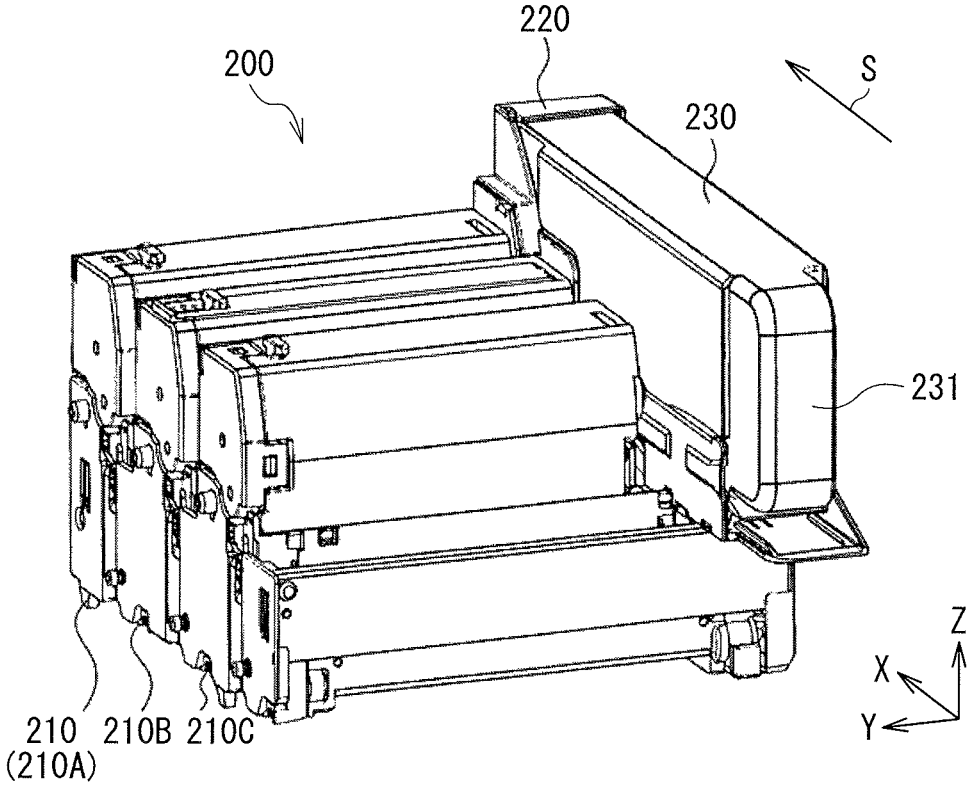
FIG. 39 is a perspective view illustrating an example of a configuration of an image forming unit according to one example embodiment of the technology.
Figure 40:
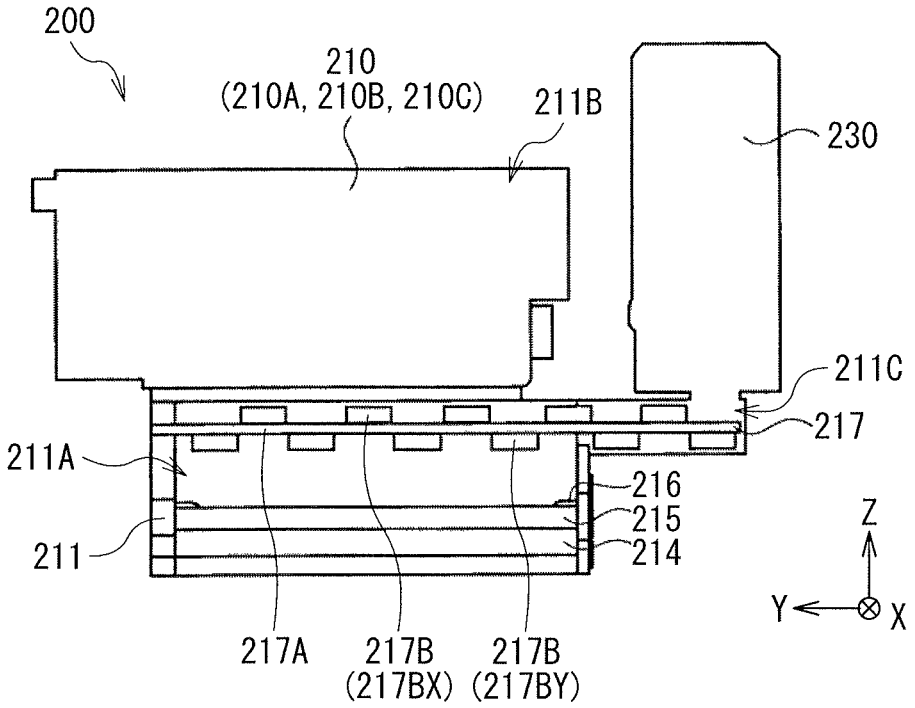
FIG. 40 is a side view illustrating an example of a configuration of the image forming unit illustrated in FIG. 39.
Figure 41:
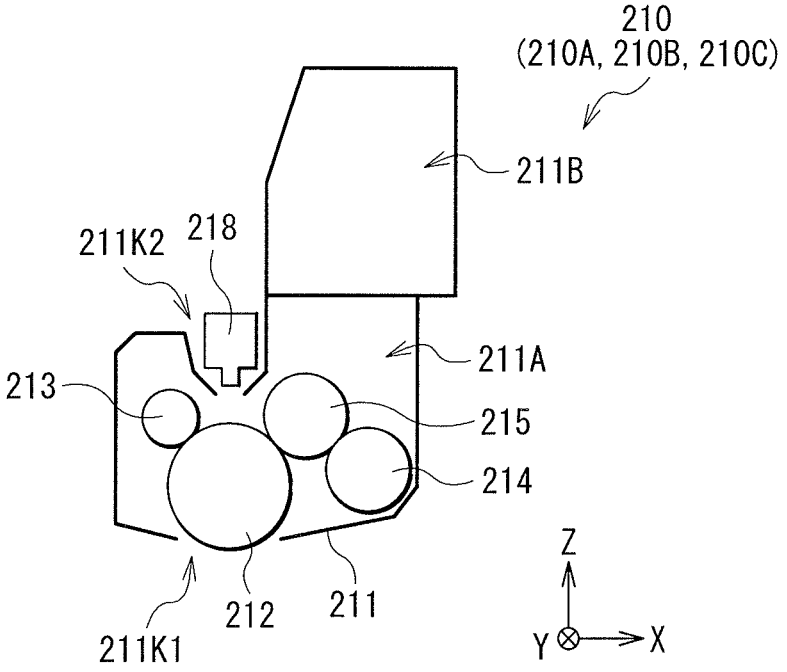
FIG. 41 is a plan view schematically illustrating an example of a configuration of a main portion, i.e., a developing process section, of the image forming unit illustrated in FIG. 39.

FIG. 39 illustrates an example of a perspective configuration of the image forming unit 200. FIG. 40 illustrates an example of a side-view configuration of the image forming unit 200 illustrated in FIG. 39. FIG. 41 schematically illustrates a planar configuration of a main portion, i.e., a developing process section 210, of the image forming unit 200 illustrated in FIG. 39. FIG. 40 illustrates an internal configuration of each of a developing process chamber 211A and a feeding channel 211C.

As illustrated in FIG. 39 and FIG. 40, for example, the image forming unit 200 may include the developing process section 210, a mounting section 220, and a containing section 230.

[Developing Process Section]

The developing process section 210 may mainly perform a developing process, and the developing process may include forming an electrostatic latent image and thereafter attaching the toner fed from the containing section 230 onto the electrostatic latent image.

Three color toners, i.e., a yellow toner, a magenta toner, and a cyan toner, may be contained in the containing section 230, as will be described later, and thus the developing process section 210 may include, for example, three developing process units 210A, 210B, and 210C that each perform the developing process.

The developing process unit 210A may attach the yellow toner onto the electrostatic latent image, for example. The developing process unit 210B may attach the magenta toner onto the electrostatic latent image, for example. The developing process unit 210C may attach the cyan toner onto the electrostatic latent image, for example.

The developing process units 210A, 210B, and 210C may have a common configuration except in that the type, e.g., the color, of the toners used in the developing process differs, for example.

In one example, as illustrated in FIG. 40 and FIG. 41, the developing process units 210A, 210B, and 210C may each include a developing process chamber 211A, a waste toner containing chamber 211B, and a feeding channel 211C, and these components may be housed in a housing 211, for example.

The developing process chamber 211A may mainly be a chamber in which the developing process is performed. Housed inside the developing process chamber 211A may be a photosensitive drum 212, a charging roller 213, a feeding roller 214, a developing roller 215, a stirring shaft 216, and a stirring paddle 217, for example. A light source 218 may be disposed outside the developing process chamber 211A, for example. The developing process chamber 211A may be coupled to each of the waste toner containing chamber 211B and the feeding channel 211C, for example. The stirring shaft 216 and the stirring paddle 217 are omitted from the drawing in FIG. 41.

The waste toner containing chamber 211B may mainly be a chamber that contains a used toner, i.e., a waste toner, collected from each of the developing process units 210A, 210B, and 210C.

The feeding channel 211C may be a channel disposed between the developing process chamber 211A and the containing section 230 and serve to convey the toner fed from the containing section 230 to the developing process chamber 211A.

The photosensitive drum 212 may mainly be a photoreceptor on which an electrostatic latent image is formed. The photosensitive drum 212 may be partially exposed through an opening 211K1 provided in the housing 211. The charging roller 213 may mainly be a roller that electrically charges the surface of the photosensitive drum 212. The feeding roller 214 may mainly be a roller that feeds the toner onto the surface of the developing roller 215 and be so pressed against the developing roller 215 as to be in contact with the developing roller 215. The developing roller 215 may mainly be a roller that attaches the toner onto the electrostatic latent image formed on the surface of the photosensitive drum 212 and be so pressed against the photosensitive drum 212 as to be in contact with the photosensitive drum 212.

The stirring shaft 216 may mainly stir the toners fed from the containing section 230 to the developing process chamber 211A. The stirring shaft 216 may be disposed closer to the feeding roller 214 and the developing roller 215 than to the containing section 230, for example. In addition, the stirring shaft 216 may extend in the Y-axis direction and be rotatable about a rotational axis extending in the Y-axis direction, for example. The stirring shaft 216 may have a three-dimensional shape that is bent in a crank shape at each of one end portion and the other end portion thereof, for example.

The stirring paddle 217 may mainly convey the toners discharged from the containing section 230 into the developing process chamber 211A while stirring the toners. The stirring paddle 217 may be disposed closer to the containing section 230 than to the feeding roller 214 and the developing roller 215, for example. In addition, the stirring paddle 217 may extend in the Y-axis direction and be rotatable about a rotational axis extending in the Y-axis direction, for example. In one example, the stirring paddle 217 may extend from the developing process chamber 211A into the feeding channel 211C.

The stirring paddle 217 may include a shaft portion 217A and a plurality of paddle portions 217B provided on the shaft portion 217A, for example. The shaft portion 217A may be a rod-shaped member that extends in the Y-axis direction and is rotatable about a rotational axis extending in the Y-axis direction, for example. The paddle portions 217B may be plate-shaped members supported by the shaft portion 217A. Features such as the number and the arrangement of the paddle portions 217B are not particularly limited. In this example, the paddle portions 217B may include a plurality of paddle portions 217BX and a plurality of paddle portions 217BY, for example. The paddle portions 217BX may be arrayed in the Y-axis direction with space provided therebetween. The paddle portions 217BY may be pointed in a direction opposite to the direction of the paddle portions 217BX and arrayed in the Y-axis direction with a space provided therebetween. The positions of the paddle portions 217BX and the positions of the paddle portions 217BY may be offset from each other in the Y-axis direction, for example.

The light source 218 may mainly be an exposure device that performs exposure on the surface of the photosensitive drum 212 via an opening 211K2 provided in the housing 211 to form an electrostatic latent image on the surface of the photosensitive drum 212. The light source 218 may be, for example, a light-emitting diode (LED) head that includes components such as an LED element or a lens array.

[Mounting Section]

The mounting section 220 may mainly be a stage member in which the containing section 230 is mounted. In the state in which the containing section 230 is mounted in the mounting section 220, the toners may be dischargeable from the containing section 230 to the developing process section 210.

[Containing Section]

The containing section 230 may mainly be a containing member that contains the toners. The containing section 230 may have a configuration similar to that of the toner cartridge 100 described above and include, for example, a holder 231, which corresponds to the holder 20. In addition, the containing section 230 may be mountable into the mounting section 220 by placing the containing section 230 on the mounting section 220 while sliding the containing section 230 in the mounting direction S. The containing section 230 may also be detachable from the mounting section 220, as necessary. FIG. 39 illustrates a state in which the containing section 230 is mounted in the mounting section 220.

A description is given with reference to the configuration of the toner cartridge 100. For example, the toners may be fed to the respective developing process units 210A, 210B, and 210C from the containing section 230 as follows. The developing process unit 210A may correspond to the containing chamber 12A. Thus, the yellow toner may be fed to the developing process unit 210A. The developing process unit 210B may correspond to the containing chamber 12B. Thus, the magenta toner may be fed to the developing process unit 210B. The developing process unit 210C may correspond to the containing chamber 12C. Thus, the cyan toner may be fed to the developing process unit 210C.

[2-2. Operation]

Next, an operation of the image forming unit 200 will be described. In this example, an operation pertaining to the developing process of the developing process unit 210A performed with the use of the yellow toner will be described, for example.

Upon the containing section 230 being mounted into the mounting section 220, the yellow toner may be fed to the developing process unit 210A from the containing section 230. In this case, upon the yellow toner being discharged from the containing section 230 into the feeding channel 211C, the stirring paddle 217 disposed inside the developing process chamber 211A and the feeding channel 211C may rotate. Thus, the yellow toner may be conveyed to the developing process chamber 211A from the feeding channel 211C by the stirring paddle 217. Upon the yellow toner being conveyed to the developing process chamber 211A, the stirring shaft 216 disposed inside the developing process chamber 211A may rotate. Thus, the yellow toner may be stirred by the stirring shaft 216.

In a case where the developing process unit 210A performs the developing process with the use of the yellow toner, upon the photosensitive drum 212 starting rotating first, the charging roller 213, while rotating, may apply a direct-current voltage to the surface of the photosensitive drum 212. Thus, the surface of the photosensitive drum 212 may be charged uniformly.

Thereafter, the light source 218 may irradiate the surface of the photosensitive drum 212 with light on the basis of image data supplied externally to the image forming unit 200. Thus, on the surface of the photosensitive drum 212, a surface potential may be attenuated, i.e., the surface may undergo photoinduced discharge, in a region irradiated with the light. Thus, an electrostatic latent image may be formed on the surface of the photosensitive drum 212.

Thereafter, a voltage may be applied to the feeding roller 214, and the feeding roller 214 may then start rotating. Thus, the yellow toner may be fed to the surface of the feeding roller 214.

Thereafter, a voltage may be applied to the developing roller 215, and the developing roller 215 may then rotate while being so pressed against the feeding roller 214 as to be in contact with the feeding roller 214. Thus, the yellow toner fed to the surface of the feeding roller 214 may be adsorbed onto the surface of the developing roller 215, and the yellow toner may be conveyed by utilizing the rotation of the developing roller 215.

Lastly, the photosensitive drum 212 may rotate while being so pressed against the developing roller 215 as to be in contact with the developing roller 215, and then the yellow toner having been adsorbed on the surface of the developing roller 215 may be transferred onto the surface of the photosensitive drum 212. Thus, the yellow toner may be attached to the surface of the photosensitive drum 212, i.e., to the electrostatic latent image, and the developing process is thus completed.

Although a detailed description is omitted in this example, the developing process may be performed through a similar procedure in each of the developing process units 210B and 210C. In other words, the magenta toner may be attached to an electrostatic latent image formed on the surface of the photosensitive drum 212 in the developing process unit 210B, and the cyan toner may be attached to an electrostatic latent image formed on the surface of the photosensitive drum 212 in the developing process unit 210C.

[2-3. Example Workings and Example Effects]

Lastly, example workings and example effects of the image forming unit 200 will be described.

In the image forming unit 200, the containing section 230 may have a configuration similar to that of the toner cartridge 100. Thus, for a reason similar to that in the case described with regard to the toner cartridge 100, the amount of the toners fed at the time of forming an image may be less likely to become insufficient, and this thus makes it possible to form a higher-quality image with the use of the image forming unit 200.

Workings and effects of the image forming unit 200 aside from the above may be similar to the workings and the effects of the toner cartridge 100.

[3. Image Forming Apparatus]

Next, an image forming apparatus according to an example embodiment of the technology will be described, and the toner container described above is used in the image forming apparatus. References will be made below to the constituent elements of the toner cartridge 100 and the image forming unit 200 described above as appropriate.

The image forming apparatus described in this example may form an image on a print medium with the use of toners of a plurality of colors, for example, and may be a full-color printer of a so-called electrophotographic scheme. The material of the print medium is not particularly limited, and non-limiting examples of the print medium may include one or more of materials such as paper and a film, for example.

[3-1. Configuration]

First, a configuration of the image forming apparatus will be described.

Figure 42:
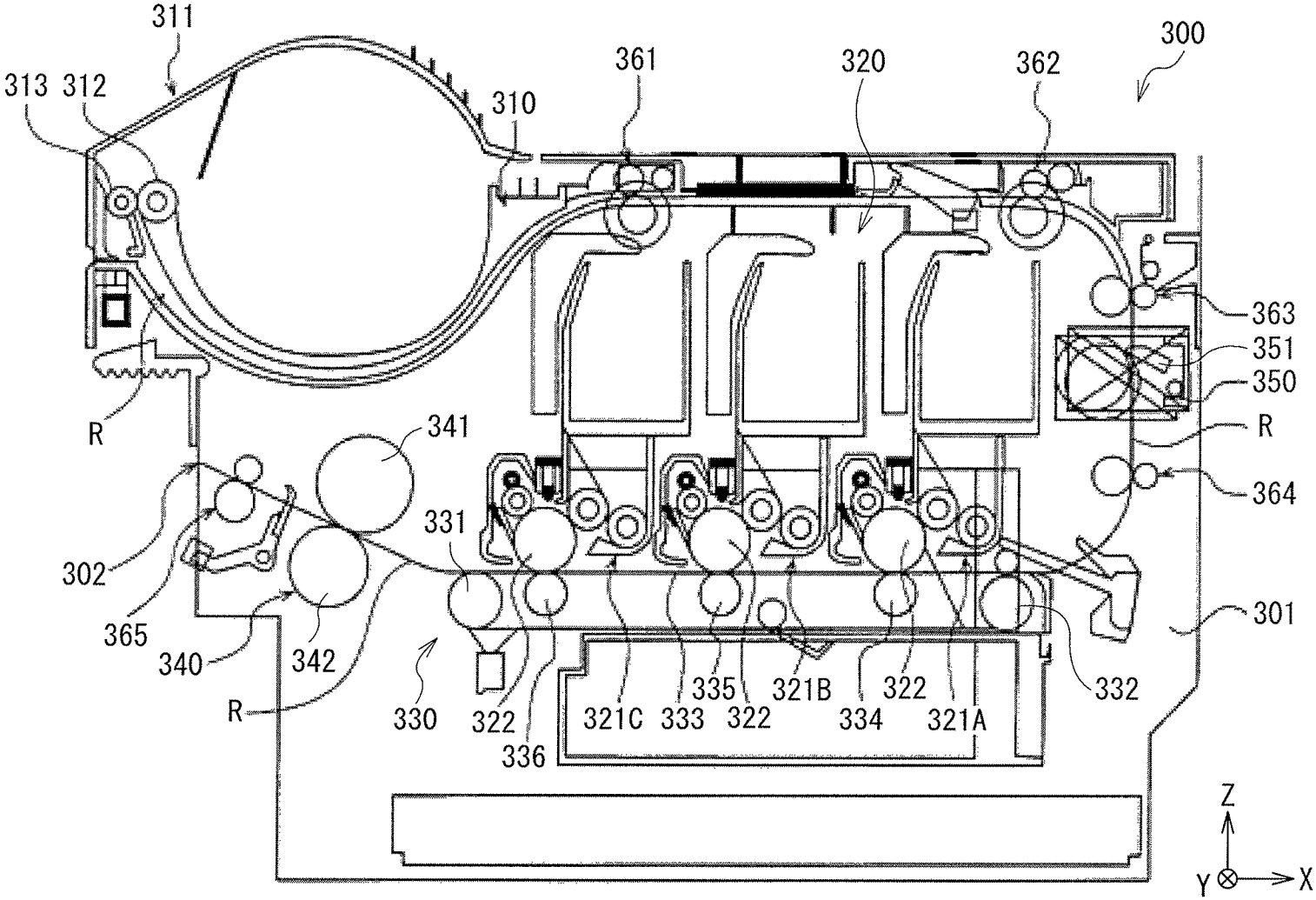
FIG. 42 is a plan view illustrating an example of a configuration of an image forming apparatus according to one example embodiment of the technology.

FIG. 42 illustrates an example of a planar configuration of an image forming apparatus 300, serving as an example of the image forming apparatus. As illustrated in FIG. 42, for example, the image forming apparatus 300 may include a print medium containing section 310, a developing section 320, a transfer section 330, a fixing section 340, and a cutting section 350, and these components may be housed in a housing 301. In the image forming apparatus 300, the print medium may be conveyed along a conveyance route R.

[Housing]

The housing 301 may mainly be a housing member that houses components such as the developing section 320, the transfer section 330, and the fixing section 340. A discharge port 302 may be provided in the housing 301, and the print medium on which an image has been formed may be discharged through the discharge port 302.

[Print Medium Containing Section]

The print medium containing section 310 may mainly contain the print medium on which an image is to be formed.

In this example, the print medium containing section 310 may contain a print medium wound in a roll form, for example. The print medium in a roll form is omitted from the drawing in FIG. 42.

The print medium containing section 310 may include a containing lid 311, a pair of feed-out rollers 312 and 313, for example. The containing lid 311 may be a lid-like member that is operable as necessary to enable the print medium in a roll form to be contained in the print medium containing section 310. The pair of feed-out rollers 312 and 313 may oppose each other with the conveyance route R interposed therebetween and also be so pressed against each other as to be in contact with each other, for example. The feed-out rollers 312 and 313 may rotate with one end portion of the print medium in a roll form pinched therebetween to thus feed out the print medium to the outside of the print medium containing section 310, for example.

[Developing Section]

The developing section 320 may have a configuration similar to that of the image forming unit 200 described above and mainly perform the developing process. The developing section 320 may be disposed downstream from the print medium containing section 310 in a conveyance route R, for example. The "conveying direction of the print medium" may be a direction in which the print medium is conveyed along the conveyance route R. For example, a conveying direction of the print medium may be a direction extending from the print medium containing section 310 toward the fixing section 340.

In one example, the developing section 320 may include, for example, three developing process units 321A, 321B, and 321C, which correspond to the developing process units 210A, 210B, and 210C, respectively. The developing process units 321A, 321B, and 321C may each include, for example, a photosensitive drum 322, which corresponds to the photosensitive drum 212. In other words, the developing process unit 321A may attach the yellow toner onto an electrostatic latent image, for example. The developing process unit 321B may attach the magenta toner onto an electrostatic latent image, for example. The developing process unit 321C may attach the cyan toner onto an electrostatic latent image, for example.

As is apparent from FIG. 42, the developing process units 321A, 321B, and 321C may be arrayed in this order from the upstream side toward the downstream side in the conveyance route R, for example. In other words, the developing process unit 321A may be disposed, for example, on the most upstream side in the conveyance route R, and the developing process unit 321C may be disposed, for example, on the most downstream side in the conveyance route R.

In FIG. 42, of the developing section 320, constituent elements corresponding to the mounting section 220 and the toner containing section 230 are omitted from the drawing. The constituent elements corresponding to the mounting section 220 and the toner containing section 230 of the developing section 320 may be disposed to the front of the developing process units 321A, 321B, and 321C in FIG. 42, for example.

[Transfer Section]

The transfer section 330 may mainly perform a transfer process, and the transfer process may include transferring the toner having been transferred to the electrostatic latent image onto the print medium. The transfer section 330 may be disposed to oppose the developing section 320 with the conveyance route R interposed therebetween, for example.

In one example, the transfer section 330 may include a driving roller 331, a driven roller 332, a transfer belt 333, and transfer rollers 334, 335, and 336, for example.

The driving roller 331 may rotate actively by utilizing force such as rotary force of a motor, for example. The driven roller 332 may rotate passively in response to the rotation of the driving roller 331, for example.

The transfer belt 333 may be an endless belt member for guiding the print medium between the developing process units 321A, 321B, and 321C and the transfer rollers 334, 335, and 336. The transfer belt 333 may be movable in response to the rotation of the driving roller 331 while being stretched upon the driving roller 331 and the driven roller 332, for example.

The transfer rollers 334, 335, and 336 may each transfer the toner attached to the electrostatic latent image onto the print medium. The transfer rollers 334, 335, and 336 may be rotatable in response to the movement of the transfer belt 333. The transfer roller 334 may oppose the photosensitive drum 322 of the developing process unit 321A and so pressed against the photosensitive drum 322 as to be in contact with the photosensitive drum 322 with the transfer belt 333 interposed therebetween, for example. The transfer roller 335 may oppose the photosensitive drum 322 of the developing process unit 321B and so pressed against the photosensitive drum 322 as to be in contact with the photosensitive drum 322 with the transfer belt 333 interposed therebetween, for example. The transfer roller 336 may oppose the photosensitive drum 322 of the developing process unit 321C and so pressed against the photosensitive drum 322 as to be in contact with the photosensitive drum 322 with the transfer belt 333 interposed therebetween, for example.

[Fixing Section]

The fixing section 340 may mainly perform a fixing process, and the fixing process may include fixing the toner transferred to the print medium onto the print medium. The fixing section 340 may be disposed downstream from the developing section 320 and the transfer section 330 in the conveyance route R, for example.

In one example, the fixing section 340 may include a heating roller 341 and a pressure applying roller 342, for example. The heating roller 341 may heat the toner transferred to the print medium. The pressure applying roller 342 may apply pressure to the toner transferred to the print medium. The pressure applying roller 342 may oppose the heating roller 341 with the conveyance route R interposed therebetween and so pressed against the heating roller 341 as to be in contact with the heating roller 341, for example.

[Cutting Section]

The cutting section 350 may mainly perform a cutting process, and the cutting process may include cutting the print medium fed from the print medium containing section 310. The cutting section 350 may be disposed between the print medium containing section 310 and the developing section 320 and transfer section 330 in the conveyance route R, for example. In one example, the cutting section 350 may include a cutter 351, for example.

[Conveying Roller]

Conveying rollers 361, 362, 363, 364, and 365 may each include a pair of rollers that oppose each other with the conveyance route R interposed therebetween. The conveying rollers 361, 362, 363, 364, and 365 may convey the print medium fed from the print medium containing section 310.

[3-2. Operation]

Next, an operation of the image forming apparatus 300 will be described. An operation of forming an image on a print medium will be described below.

In a case where an image is formed on a print medium, the image forming apparatus 300 may mainly perform the developing process, the transfer process, the fixing process, and the cutting process in this order, as will be described below, for example.

First, upon the print medium in a roll form being contained in the print medium containing section 310, one end portion of the print medium in a roll form may be pinched by the feed-out rollers 312 and 313, and the feed-out rollers 312 and 313 may each rotate in this state. Accordingly, the print medium may be conveyed along the conveyance route R, and the print medium may thus be fed from the print medium containing section 310 to the developing section 320 and the transfer section 330.

[Developing Process]

Thereafter, in the developing section 320, an operation similar to that of the image forming unit 200 described above may be performed in each of the developing process units 321A, 321B, and 321C. Thus, the developing process may be performed by the developing section 320, and the toners, i.e., the yellow toner, the magenta toner, and the cyan toner, may each be attached to an electrostatic latent image.

[Transfer Process]

Thereafter, in the transfer section 330, upon the driving roller 331 starting rotating, the driven roller 332 may rotate in response to the rotation of the driving roller 331. Thus, the transfer belt 333 may move from the upstream side toward the downstream side in the conveyance route R, and the transfer rollers 334, 335, and 336 may each rotate.

In the transfer process, a voltage may be applied to each of the transfer rollers 334, 335, and 336. In this case, the transfer rollers 334, 335, and 336 may be so pressed against the respective photosensitive drums 322 of the developing process units 321A, 321B, and 321C as to be in contact with the respective photosensitive drums 322 with the transfer belt 333 interposed therebetween. Thus, the toners attached to the surfaces of the photosensitive drums 322, i.e., to the electrostatic latent images, in the developing process described above may be transferred onto the print medium while the print medium is passing between the developing process units 321A, 321B, and 321C and the transfer rollers 334, 335, and 336.

In other words, the yellow toner may be transferred onto the print medium when the print medium passes between the developing process unit 321A and the transfer roller 334. The magenta toner may be transferred onto the print medium when the print medium passes between the developing process unit 321B and the transfer roller 335. The cyan toner may be transferred onto the print medium when the print medium passes between the developing process unit 321C and the transfer roller 336.

It is to be noted that whether the transfer process is actually performed with the use of the yellow toner, the magenta toner, and the cyan toner may be determined in accordance with the color, or a combination of colors, necessary for forming an image.

[Fixing Process]

Thereafter, the print medium onto which the toners have been transferred in the transfer process may continue to be conveyed along the conveyance route R and submitted into the fixing section 340.

In the fixing process, in a state in which the surface temperature of the heating roller 341 is controlled to a predetermined temperature, the pressure applying roller 342 may rotate while being so pressed against the heating roller 341 as to be in contact with the heating roller 341. Thus, the print medium may be so conveyed as to pass between the heating roller 341 and the pressure applying roller 342.

In this case, the toners transferred to the print medium may be heated by the heating roller 341, and thus the toners may melt. Furthermore, the toners in a molten state may be so pressed against the print medium by the pressure applying roller 342 as to be in contact with the print medium, and thus the toners may be fixed to the print medium.

[Cutting Process]

Lastly, in the cutting process, after an image has been formed on the print medium, the print medium, or a portion of the print medium in which the image is not formed, may be cut by the cutter 351 in the cutting section 350. Thus, the print medium on which the image has been formed may be separated from the print medium in a roll form and discharged through the discharge port 302.

The timing at which the print medium is cut by the cutting section 350 is not particularly limited and may be modified as desired. In one example, the timing at which the print medium is cut is not limited to the timing after the image is formed on the print medium, and the print medium may be cut before the image is formed on the print medium or while the image is being formed on the print medium, for example.

[3-3. Example Workings and Example Effects]

Lastly, example workings and example effects of the image forming apparatus 300 will be described.

In the image forming apparatus 300, the developing section 320 may have a configuration similar to that of the image forming unit 200, and the developing section 320 may thus include a constituent element that corresponds to the containing section 230. Accordingly, for a reason similar to that in the case described with regard to the toner cartridge 100 and the image forming unit 200, the amount of the toners fed at the time of forming an image may be less likely to become insufficient, and this thus makes it possible to form a higher-quality image with the use of the image forming apparatus 300.

Workings and effects of the image forming apparatus 300 aside from the above may be similar to the workings and the effects of the toner cartridge 100 and the image forming unit 200.

Thus far, the technology has been described referring to some example embodiments. However, the technology is not limited to the example embodiments described above, and various modifications are possible.

In one example, the image forming apparatus according to one example embodiment of the technology is not limited to a printer, and may be any other apparatus such as a copier, a facsimile, and a multifunction peripheral.

It is possible to achieve at least the following configurations from the above-described example embodiments of the technology.

(1) A toner container, including:

a plurality of containing chambers that are arrayed in a first direction and partitioned from each other, the containing chambers containing respective toners of colors different from each other;

a shaft member that extends in the first direction and passes through each of the containing chambers, the shaft member being rotatable about a rotational axis extending in the first direction;

a plurality of rotary members disposed in the respective containing chambers, the rotary members each having a through-hole extending in the first direction, the rotary members being rotatable in response to rotation of the shaft member in an inserted state of the shaft member in the through-holes; and a plurality of stirring members supported by the respective rotary members, the stirring members each extending in a second direction intersecting the first direction, the stirring members being pivotable in response to rotation of the respective rotary members, the stirring members having pivoting positions different from each other upon pivoting.

(2) The toner container according to (1), in which the shaft member is in an inserted state in the through-holes provided in the respective rotary members and thereby makes phases of the respective stirring members differ from each other in a pivoting direction.

(3) The toner container according to (1) or (2), in which angles of rotation of the shaft member held when the respective rotary members start rotating are on one of a gradual increase and a gradual decrease in accordance with order of locations, in the first direction, of the rotary members that start rotating.

(4) The toner container according to any one of (1) to (3), in which each of the stirring members includes a plurality of stirrers arrayed in the first direction.

(5) The toner container according to any one of (1) to (4), further including a housing having the containing chambers thereinside and a plurality of discharge ports that are provided at positions corresponding to the respective containing chambers and through which the respective toners of colors different from each other are discharged, in which in a state held before each of the rotary members starts rotating, the stirring members extend in a direction away from the respective discharge ports.

(6) The toner container according to (5), in which the stirring members extend in a common direction.

(7) The toner container according to (5), in which before the shaft member starts rotating, the stirring members extend in a common direction, and when the rotary members each rotate in response to the rotation of the shaft member, the rotary members start rotating at timing different from each other.

(8) The toner container according to any one of (1) to (7), in which the shaft member has a three-dimensional shape that is engageable with the plurality of through-holes provided in the respective rotary members at angles of rotation different from each other.

(9) The toner container according to (8), in which a shape of an opening of each of the through-holes is a shape that includes an engagement portion, and a cross-sectional shape of the shaft member inside each of the containing chambers is one of (A) a first shape having one non-rotating engaging portion that engages with the engagement portion before the shaft member starts rotating, and (B) a second shape having one or more rotating engaging portions that are engageable with the engagement portion after the shaft member starts rotating and one or more non-engaging portions that are not engageable with the engagement portion irrespective of the rotation of the shaft member.

(10) The toner container according to (9), in which the cross-sectional shape of the shaft member inside one of the containing chambers is the first shape, each of the cross-sectional shapes of the shaft member inside two or more of the containing chambers is the second shape, and the two or more cross-sectional shapes of the shaft member that are each the second shape differ from each other.

(11) An image forming unit, including:

a containing section that contains toners of colors different from each other; and a developing process section that attaches the toners of colors different from each other and fed from the containing section onto a latent image, the containing section including:

a plurality of containing chambers that are arrayed in a first direction and partitioned from each other, the containing chambers containing the respective toners of colors different from each other;

a shaft member that extends in the first direction and passes through each of the containing chambers, the shaft member being rotatable about a rotational axis extending in the first direction;

a plurality of rotary members disposed in the respective containing chambers, the rotary members each having a through-hole extending in the first direction, the rotary members being rotatable in response to rotation of the shaft member in an inserted state of the shaft member in the through-holes; and a plurality of stirring members supported by the respective rotary members, the stirring members each extending in a second direction intersecting the first direction, the stirring members being pivotable in response to rotation of the respective rotary members, the stirring members having pivoting positions different from each other upon pivoting.

(12) An image forming apparatus, including:

a developing section including a containing section and a developing process section, the containing section containing toners of colors different from each other, the developing process section attaching the toners of colors different from each other and fed from the containing section onto a latent image;

a transfer section that transfers, onto a print medium, the toners of colors different from each other and attached to the latent image; and a fixing section that fixes, to the print medium, the toners of colors different from each other and transferred onto the print medium, the containing section including:

a plurality of containing chambers that are arrayed in a first direction and partitioned from each other, the containing chambers containing the respective toners of colors different from each other;

a shaft member that extends in the first direction and passes through each of the containing chambers, the shaft member being rotatable about a rotational axis extending in the first direction;

a plurality of rotary members disposed in the respective containing chambers, the rotary members each having a through-hole extending in the first direction, the rotary members being rotatable in response to rotation of the shaft member in an inserted state of the shaft member in the through-holes; and a plurality of stirring members supported by the respective rotary members, the stirring members each extending in a second direction intersecting the first direction, the stirring members being pivotable in response to rotation of the respective rotary members, the stirring members having pivoting positions different from each other upon pivoting.

According to each of the toner container, the image forming unit, and the image forming apparatus of one embodiment of the technology, the toner container, or a container, contains toners of colors different from each other, and pivoting positions of the stirring members held when the stirring members pivot differ from each other. Accordingly, it is possible to form a higher-quality image.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A toner container, comprising:

a plurality of containing chambers that are arrayed in a first direction and partitioned from each other, the containing chambers containing respective toners of colors different from each other;

a shaft member that extends in the first direction and passes through each of the containing chambers, the shaft member being rotatable about a rotational axis extending in the first direction;

a plurality of rotary members disposed in the respective containing chambers, the rotary members each having a through-hole extending in the first direction, the rotary members being rotatable in response to rotation of the shaft member in an inserted state of the shaft member in the through-holes; and a plurality of stirring members supported by the respective rotary members, the stirring members each extending in a second direction intersecting the first direction, the stirring members being pivotable in response to rotation of the respective rotary members, the stirring members having pivoting positions different from each other upon pivoting.

2. The toner container according to claim 1, wherein the shaft member is in an inserted state in the through-holes provided in the respective rotary members and thereby makes phases of the respective stirring members differ from each other in a pivoting direction.

3. The toner container according to claim 1, wherein angles of rotation of the shaft member held when the respective rotary members start rotating are on one of a gradual increase and a gradual decrease in accordance with order of locations, in the first direction, of the rotary members that start rotating.

4. The toner container according to claim 1, wherein each of the stirring members includes a plurality of stirrers arrayed in the first direction.

5. The toner container according to claim 1, further comprising a housing having the containing chambers thereinside and a plurality of discharge ports that are provided at positions corresponding to the respective containing chambers and through which the respective toners of colors different from each other are discharged, wherein in a state held before each of the rotary members starts rotating, the stirring members extend in a direction away from the respective discharge ports.

6. The toner container according to claim 5, wherein the stirring members extend in a common direction.

7. The toner container according to claim 5, wherein before the shaft member starts rotating, the stirring members extend in a common direction, and when the rotary members each rotate in response to the rotation of the shaft member, the rotary members start rotating at timing different from each other.

8. The toner container according to claim 1, wherein the shaft member has a three-dimensional shape that is engageable with the plurality of through-holes provided in the respective rotary members at angles of rotation different from each other.

9. The toner container according to claim 8, wherein a shape of an opening of each of the through-holes is a shape that includes an engagement portion, and a cross-sectional shape of the shaft member inside each of the containing chambers is one of (A) a first shape having one non-rotating engaging portion that engages with the engagement portion before the shaft member starts rotating, and (B) a second shape having one or more rotating engaging portions that are engageable with the engagement portion after the shaft member starts rotating and one or more non-engaging portions that are not engageable with the engagement portion irrespective of the rotation of the shaft member.

10. The toner container according to claim 9, wherein the cross-sectional shape of the shaft member inside one of the containing chambers is the first shape, each of the cross-sectional shapes of the shaft member inside two or more of the containing chambers is the second shape, and the two or more cross-sectional shapes of the shaft member that are each the second shape differ from each other.

11. An image forming unit, comprising:

a containing section that contains toners of colors different from each other; and a developing process section that attaches the toners of colors different from each other and fed from the containing section onto a latent image, the containing section including:

a plurality of containing chambers that are arrayed in a first direction and partitioned from each other, the containing chambers containing the respective toners of colors different from each other;

a shaft member that extends in the first direction and passes through each of the containing chambers, the shaft member being rotatable about a rotational axis extending in the first direction;

a plurality of rotary members disposed in the respective containing chambers, the rotary members each having a through-hole extending in the first direction, the rotary members being rotatable in response to rotation of the shaft member in an inserted state of the shaft member in the through-holes; and a plurality of stirring members supported by the respective rotary members, the stirring members each extending in a second direction intersecting the first direction, the stirring members being pivotable in response to rotation of the respective rotary members, the stirring members having pivoting positions different from each other upon pivoting.

12. An image forming apparatus, comprising:

a developing section including a containing section and a developing process section, the containing section containing toners of colors different from each other, the developing process section attaching the toners of colors different from each other and fed from the containing section onto a latent image;

a transfer section that transfers, onto a print medium, the toners of colors different from each other and attached to the latent image; and a fixing section that fixes, to the print medium, the toners of colors different from each other and transferred onto the print medium, the containing section including:

a plurality of containing chambers that are arrayed in a first direction and partitioned from each other, the containing chambers containing the respective toners of colors different from each other;

a shaft member that extends in the first direction and passes through each of the containing chambers, the shaft member being rotatable about a rotational axis extending in the first direction;

a plurality of rotary members disposed in the respective containing chambers, the rotary members each having a through-hole extending in the first direction, the rotary members being rotatable in response to rotation of the shaft member in an inserted state of the shaft member in the through-holes; and a plurality of stirring members supported by the respective rotary members, the stirring members each extending in a second direction intersecting the first direction, the stirring members being pivotable in response to rotation of the respective rotary members, the stirring members having pivoting positions different from each other upon pivoting.

* * * * *